US005723266A

United States Patent [19]

Morimoto

[11] Patent Number: 5,723,266

[45] Date of Patent: Mar. 3, 1998

[54] METHOD OF PROCESSING SILVER HALIDE PHOTOSENSITIVE MATERIAL

[75] Inventor: Kiyoshi Morimoto, Minami-ashigara, Japan

[73] Assignee: Fuji Photo Film Co., Ltd., Tokyo, Japan

[21] Appl. No.: 720,082

[22] Filed: Sep. 27, 1996

[30] Foreign Application Priority Data

Sep. 27, 1995 [JP] Japan ..... 7-272116

[51] Int. Cl.[6] ..... G03C 7/44

[52] U.S. Cl. ..... 430/398; 430/372; 430/428; 430/463; 396/396; 396/398

[58] Field of Search ..... 430/357, 434, 430/372, 398, 428, 463; 396/396, 398

[56] References Cited

U.S. PATENT DOCUMENTS

| | | | |
|---|---|---|---|
| 5,357,307 | 10/1994 | Glanville et al. | 396/636 |
| 5,379,087 | 1/1995 | Devaney et al. | 396/636 |
| 5,391,467 | 2/1995 | Yoshida et al. | 430/434 |
| 5,413,900 | 5/1995 | Yokota | 430/495 |

FOREIGN PATENT DOCUMENTS

| | | |
|---|---|---|
| 468336 | 3/1992 | Japan . |
| 473737 | 3/1992 | Japan . |
| 588283 | 4/1993 | Japan . |

*Primary Examiner*—Hoa Van Le
*Attorney, Agent, or Firm*—Birch, Stewart, Kolasch & Birch, LLP

[57] ABSTRACT

A method of processing a photosensitive material is provided in which change in photographic properties is not caused and reading properties for magnetic recording information of a photosensitive material including a magnetic recording layer does not deteriorate. In the method of processing a photosensitive material using a photosensitive material processing apparatus in which a photosensitive material is immersed in processing solutions respectively accommodated in a plurality of processing tanks which are provided adjacent to each other along a direction in which the photosensitive material is conveyed, the photosensitive material processing apparatus includes a conveying roller pair for conveying the photosensitive material, which is provided in at least one portion of the processing apparatus, and a partition portion which is partitioned by a roller provided between adjacent processing tanks of the plurality of processing tanks and which allows the photosensitive material to pass therethrough. Further, a processing solution in at least one processing tank is covered by a fluid layer floating on a liquid surface thereof.

19 Claims, 8 Drawing Sheets

METHOD OF PROCESSING SILVER HALIDE PHOTOSENSITIVE MATERIAL

BACKGROUND OF THE INVENTION

1. Field of the Invention

The present invention relates to a method of processing a photosensitive material by using a photosensitive material processing apparatus in which a photosensitive material on which images have been exposed is immersed and processed in processing solutions, more particularly, to a method of processing a photosensitive material by using a photosensitive material processing apparatus in which the photosensitive material is conveyed by a roller pair in at least one portion of the processing apparatus, a sealing structure is provided at the periphery of a roller in a conveying path for conveying the photosensitive material through a partition portion between adjacent processing tanks to a downstream-side processing tank of the adjacent processing tanks, and the surface or the processing solution in each of the processing tanks is covered by a fluid layer floating on the processing solution.

2. Description of the Related Art

In a photosensitive material processing apparatus, for example, art automatic processing apparatus, in which a photosensitive material such as a film on which images have been exposed, or the like is processed, the photosensitive material is successively processed with color developing solution, bleach-fixing solution, washing water and the like, and is dried afterward. In such an automatic processing apparatus, the photosensitive material is generally pulled out into the air from an upstream-side processing tank of adjacent processing tanks and is conveyed into a downstream-side processing tank of the adjacent processing tanks. The photosensitive material is pulled out into the air between the adjacent processing tanks so that mixing of the processing solutions in the adjacent processing tanks is prevented.

The photosensitive material is not substantially processed with a processing solution during the time when the photosensitive material is pulled out from the processing solution. Accordingly, in order to achieve shortening of a processing time of the photosensitive material, various types of automatic processing apparatuses in which a conveying path is constructed such that the photosensitive material is directly conveyed from an upstream-side processing tank to a downstream-side processing tank have been proposed.

In such an automatic processing apparatus, a blade is provided at an opening formed in a partition between the adjacent processing tanks, through which a film passes, so as to prevent the processing solutions in the upstream-side and downstream-side processing tanks from flowing through the opening and mixing each other, and the photosensitive material passes through the opening by widening the blade. However, when the blade is provided, the conveying characteristics of the photosensitive material is deteriorated due to friction between the photosensitive material and the blade generated by the photosensitive material passing through the opening.

In order to avoid the drawback described above, there exists a structure in which a roller is provided at the opening and a space between the opening and the peripheral surface of the roller is closed by the blade. The photosensitive material can be correctly conveyed by being nipped and sent out by the roller provided at the opening.

However, even when the opening is closed by the roller and the blade, a clearance is formed between each of the end surfaces of the roller and each of side walls for supporting the roller. Accordingly, a problem is caused in that the processing solutions in the upstream-side processing tank and the downstream-side processing tank flow through the clearance and are mixed with each other.

A sealing structure of a roller which is used in a method of processing a photosensitive material according to the present invention is contemplated in view of the above-described circumstances. The present invention is to provide a method of processing a photosensitive material using a photosensitive material processing apparatus which has a sealing structure for securely sealing the periphery of the roller which is rotating, without the conveying characteristics being deteriorated, and in which a photosensitive material is reliably conveyed without being pulled out of the processing solutions.

Conventionally, it was almost impossible that various information is inputted in or outputted from a silver halide photosensitive material (hereinafter referred to as "photosensitive material") when the photosensitive material is exposed or images on the photosensitive material are printed. Only the information regarding date and time of photographing can optically be inputted and outputted. JP-A No. 4-68886, JP-A No. 4-78787 and JP-A No. 5-88283 disclose a photosensitive material having a transparent magnetic recording layer on the entire surface thereof, in which date and time of photographing, photographing conditions such as weather conditions at photographing, reduction/enlargement ratios, number off reprints, portions to be zoomed, messages, development/printing conditions and the like can be inputted on the recording layer of the photosensitive material. This method can be used for providing such information on when an image is inputted into audio visual apparatuses such as a television system and/or a video system, which is favorable in the future.

In the above-described methods of processing the photosensitive material, color development, desilverization, washing and stabilization are generally effected. Meanwhile, demands for rapid photofinishing and for reduction in quantities of waste solution have been increased as complete processing at various smaller shops or "mini-labs" (rather than forwarding the film to a laboratory for printing processing) has become popular. Accordingly, methods of reduction in each of the processing times and reduction in quantities of replenishing solutions in the above-described processing steps have been examined. In particular, for the purpose of reduction in color developing time, it is most preferable that concentration of color developing agent is made higher and processing temperature is increased, since shortening of processing time can be achieved without deterioration of photographic characteristics.

It has been found that when the above-described roller is applied to a washing process and/or a stabilizing process In a plurality of processing tanks (for example, three tanks), and a rapid processing in which a total processing time off the washing process and/or the stabilizing process is 15 seconds to 60 seconds is carried out, or running processing in which the total quantity of replenishment in the washing process and/or the stabilizing process is reduced is carried out, the change in minimum density of yellow before and after the running processing becomes large, and magnetic recording properties are deteriorated (deterioration in S/N ratio) so that sufficient information cannot be obtained.

In a case in which the photosensitive material is processed by a photosensitive material processing apparatus with the above-described roller arrangement, if there is a small quantity of a replenisher in the washing process and/or stabilizing process (for example, the total quantity of replenishment in the washing process and/or the stabilizing process is 800 ml or less), or if the processing time is short (for example, the total processing time of the washing process and/or the stabilizing process is 60 seconds or less), it was found that components of the processing solution carried over from the preceding bath of the washing process and/or the stabilizing process, or components dissolved from the photosensitive material into the washing bath and/or the stabilizing bath changes due to air oxidation or the like, with the result that stains increase after the processing of the photosensitive material and the minimum density of yellow ($\Delta D_{min}$) becomes higher. Further, it was also found that dirts are adhered to a reading head for magnetic recording and output of magnetic recording information deteriorates.

In JP-A No. 1-810851, there is disclosed a technique in which a surface of a processing solution in a processing tank is covered by a fluid layer floating on the processing solution so as to prevent evaporation of the processing solution, drop in temperature of the processing solution, and air oxidation. However, this technique includes no description about influences on the photographic properties of a super-rapid processing of the washing process and/or the stabilizing process or a super-reducing processing of the quantity of the replenishing solution, and on the output of magnetic recording information.

Further, even when the rapid processing (i.e., the total processing time of the washing process and/or the stabilizing process is 60 seconds or less) and the replenisher-reducing processing (i.e., the total quantity of the replenisher in the washing process and/or the stabilizing process is 800 ml/ $m^2$ or less) are effected, deterioration off the photographic properties and reduction in output of the magnetic recording information cannot be improved.

SUMMARY OF THE INVENTION

Accordingly, a first object of the present invention is to provide a method of processing a photosensitive material by using a photosensitive material processing apparatus having a plurality of processing tanks, more specifically, to provide the photosensitive material processing apparatus in which there is a little change in photographic properties before and after the processing of the photosensitive material and no reduction in output of magnetic recording information when low replenishment and rapid processing are carried out, by using the photosensitive material processing apparatus including a pair of conveying rollers for conveying the photosensitive material, the pair of rollers being provided in at least one portion of the processing apparatus, and a partition portion which is partitioned by a roller provided in at least one of the spaces between the adjacent processing tanks and which allows the photosensitive material to pass through therein.

A second object of the present invention is to provide a method of processing a photosensitive material, in which there is a little change in photographic properties of the photosensitive material before and after running processing and no reduction on in output of magnetic recording information when low replenishment and rapid processing of the photosensitive material are carried out with a processing solution in an at least washing bath and/or stabilizing bath in a plurality of processing tanks being covered by a fluid layer floating on the processing solution, by using a photosensitive material processing apparatus including a plurality of processing tanks each having a partition portion through which the photosensitive material can pass, the processing apparatus being partitioned by a roller provided in at least one of adjacent processing tanks of the plurality of processing tanks.

Further, a third object of the present invention is to provide a method of processing a photosensitive material, in which there is a little change in photographic properties of the photosensitive material before and after running processing and no reduction in output of magnetic recording information when low replenishment and rapid processing of the photosensitive material are carried out with a processing solution in an at least washing bath and/or stabilizing bath of a plurality of processing tanks being covered by a fluid layer floating on the processing solution, by using a photosensitive material processing apparatus including a plurality of processing tanks each having a partition portion through which the photosensitive material can pass, the processing apparatus being partitioned by a roller whose periphery is sealed in at least one portion of adjacent processing tanks.

It has been found that the above object can be accomplished by the following processing methods.

There is disclosed a method of processing a silver halide photosensitive material using a photosensitive material processing apparatus in which a photosensitive material is immersed and processed in a processing solution having a developing capability, a processing solution having a desilverizing capability and a processing solution for at least one of washing and stabilization, these processing solutions being respectively accommodated in a plurality of processing tanks disposed adjacent to each other along a direction in which the photosensitive material is conveyed, the photosensitive material processing apparatus comprising: a conveying roller pair for conveying the photosensitive material, which is provided in at least one portion of the photosensitive material processing apparatus: and a partition portion which is partitioned by a roller which is provided in at least one portion between adjacent processing tanks of the plurality of processing tanks to allow the photosensitive material to pass therethrough, wherein a processing solution in at least one of the plurality of processing tanks is covered by a fluid layer which floats on a liquid surface of the processing solution.

In the above-described processing method, preferably, the fluid layer is formed on the surface of the processing solution in at least the processing tank for at least one of washing and stabilization of the plurality of processing tanks.

Further, in the processing method of the present invention, preferably, the photosensitive material processing apparatus includes a partition which is provided to separate the processing tanks from each other and in which an opening through which the photosensitive material can pass is formed; a pair of side plates projecting from vicinities of the opening of the partition; a roller which is interposed between the pair of side plates and contacts the photosensitive material passing through the opening so as to capable of applying conveying force to the photosensitive material; a first sealing means which seals clearances between an upper surface of a peripheral surface of the roller along an axial direction of the roller and a peripheral edge of the opening of the partition, and between a lower surface of the peripheral surface of the roller along the axial direction of the roller and the peripheral edge of the opening of the partition, so as to prevent flowing of the processing solutions therebetween; and a second sealing means which is provided between one end surface of the roller and one of the pair of side plates, and between the other end surface of the roller and the other of the pair of side plates, and seals clearances between the end surfaces of the roller and the pair of side plates to prevent the processing solution from flowing through the clearances.

Still further, in the processing method of the present invention, preferably, a total processing time of the photosensitive material with the processing solution for at least one of washing and stabilizing is 15 seconds to 60 seconds.

Moreover, preferably, an amount of a replenisher of the processing solution for at least one of washing and stabilizing is 130 to 800 ml per 1 $m^2$ of the photosensitive material.

Further, in the processing method of the present invention, preferably, the photosensitive material has, on a support thereof, at least one red sensitive layer, at least one green sensitive layer, at least one blue sensitive layer, and a magnetic recording layer containing magnetic particles.

It is preferred that the fluid which covers the processing solution in a washing tank or a stabilizing tank has water content of 10% by weight or less, a specific gravity of 1.000 or less, a boiling point off 100° C. or more, and substantially does not react with washing water or a stabilizing solution, and has a relative dielectric constant of 2 to 20.

Further, preferably, the fluid is at least one compound selected from the group of liquid paraffin and liquid saturated hydrocarbons having 8 to 16 carbons.

DESCRIPTION OF THE PREFERRED EMBODIMENTS

Figure 1:
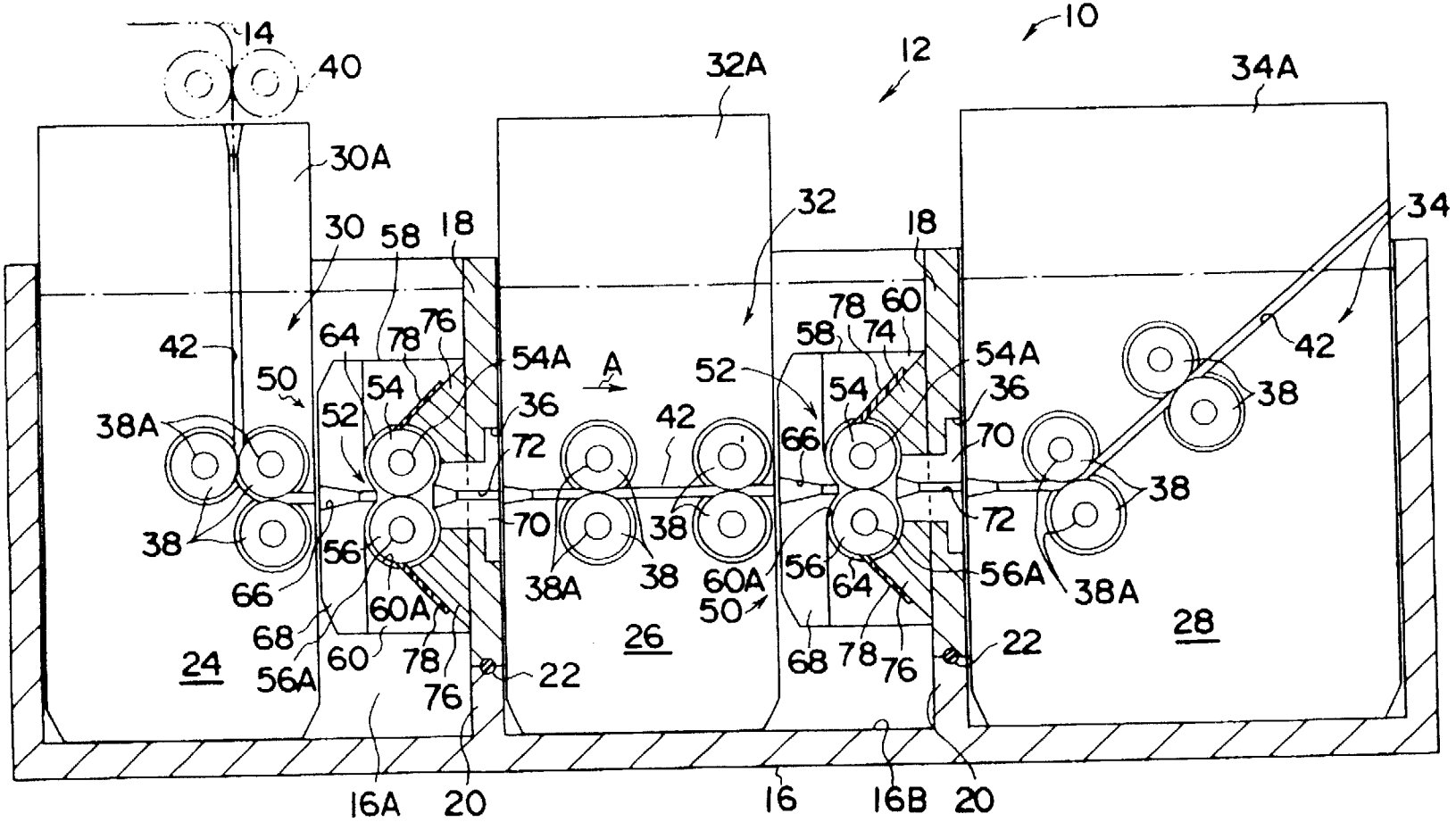
FIG. 1 is a schematic cross-sectional view showing a processing section of an automatic processing apparatus used in a method of processing a photosensitive material according to the present invention.

A sealing structure of a roller in a photosensitive material processing apparatus which is preferably used in a method of processing a photosensitive material according to the present invention is formed to seal the periphery of The roller by a first sealing means and a second sealing means, the first sealing means being formed to project from an opening peripheral edge of a partition plate of a processing tank toward upper and lower portions of the peripheral surface of the roller and contact the roller along an axial direction of the roller to close a clearance between the peripheral surface of the roller and the partition plate, thereby preventing flow of a processing solution, and the second sealing means being provided between end surfaces of the roller and side plates facing the end surfaces to close clearances between the side plates and the roller end surfaces, thereby preventing flow of a processing solution between the opening side partitioned by the roller and the first sealing means and the opposite side of the opening.

A photosensitive material processing apparatus which preferably used i n the method of processing photosensitive material according to the present invention, is constructed in that the photosensitive material is immersed and processed in processing solutions accommodated in a plurality of processing tanks which are disposed adjacent to each other in a direction in which the photosensitive material is conveyed, and the photosensitive material is conveyed by a pair of rollers in at least one portion of the processing apparatus. Further, the photosensitive material processing apparatus comprises: a partition which separates adjacent processing tanks from each other and which has an opening through which the photosensitive material can pass; a pair of side plates projecting from vicinities of the opening of the partition; a roller which is held by and between the pair of side plates and which contacts the photosensitive material which is passing through the opening so as to apply conveying force to the photosensitive material; a first sealing means which seals clearances between an upper portion of a peripheral surface of the roller along an axial direction thereof and a peripheral edge of the opening of the partition, and between a lower portion of the peripheral surface of the roller along the axial direction thereof and a peripheral edge of the opening of the partition so as to prevent flow of the processing solution; and a second sealing means which is provided between each end surface of the roller and each side plate to seal, each of the clearances between the end surfaces of the roller and the side plates and prevent flow of the processing solution.

A pair of rollers is provided in at least one portion of the processing tank in order to convey the photosensitive material. The pair of rollers may be disposed in any portion of the processing tank, and for example, may be disposed in the opening formed in the partition for separating the processing tanks from each other. So long as the pair of rollers is provided in one portion of the processing tank, one roller suffices which is provided in the opening formed in the partition for separating the processing tanks from each other.

In an example of the photosensitive material processing apparatus which is preferably used in the present invention, the second sealing means is one of an elastic member which is disposed between the side plates and the end surfaces of the roller and is not water-absorbent, a sliding member of low frictional force which is disposed on the surface of the side plates or disposed between the side plates and the end surface of the roller, and a water-repellent sealing member in a gel state which is disposed between the side plates and the end surface of the roller.

In the sealing structure at the periphery of the roller according to the present invention, in addition to the first sealing means which contacts the peripheral surface of the roller, the second sealing means is provided between the side plates and each of the end surfaces of the roller. As a result, the entire periphery of the roller which is rotating can be tightly sealed. For example, the roller is disposed in the opening provided at the partition and a space between the periphery of the roller and the peripheral edge of the opening formed in the partition is sealed by the first sealing means and the second sealing means, thereby reliably preventing flow of fluid passing through the opening.

In a photosensitive material processing apparatus which is preferably used in the present invention, the peripheral edge of the opening formed in the partition provided between processing tanks disposed adjacent to each other is surrounded by the pair of side plates between which the roller is placed and the first sealing member which contacts the peripheral surface of the roller. Further, the second sealing means is provided between each of the end surfaces of the roller and each of the side plates.

in addition to various structures for sealing clearances created in the vicinities of the peripheral surface of the roller, clearances between each of the end surfaces of the roller and each of the side plates supporting the roller can also be sealed, and the entire periphery of rotating roller is reliably sealed accordingly.

As a result, the photosensitive material can be effectively processed without the processing solutions in the adjacent processing tanks being mixed with each other. Further, since the roller is disposed at a position where the processing solutions in the adjacent processing tanks are partitioned, the photosensitive material can be correctly conveyed.

In the photosensitive material processing apparatus which is preferably used in the present invention, an elastic body is provided between each of the side plates and each of the end surfaces of the roller so as to closely seal the clearances between the side plates and each of the end surfaces of the roller. Non-water-absorbent body which does not absorb the processing solution may be preferably used as the elastic body. Further, the elastic body may be provided on either of the side plates and each of the end surfaces of the roller. When the roller is mounted to each of the side plates, the elastic body may be formed to elastically deform without preventing rotation of the roller, so as to closely seal the clearance between each of the end surfaces of the roller and each of the side plates.

In the photosensitive material processing apparatus which is preferably used in the present invention, the clearance between the end surface off the roller and the side plate is sealed by a sliding member disposed between the end surface of the roller and the side plate. By bringing the sliding member into contact with the end surface of the roller, the roller can be smoothly rotated without unnecessary load being applied to The roller. Meanwhile, in this case, the end surface of the roller may be provided to directly contact the side plate, the end surface of the roller and the side plate each being formed of a member having a low frictional resistance.

In the photosensitive material processing apparatus which is preferably used in the present invention, a gel-like sealing member is provided between the side plate and the end surface of the roller. When the gel-like sealing member is used, the clearance between the side plate and the end surface of the roller can be closely sealed and mixing of the processing solutions can be reliably prevented. Meanwhile, as the sealing member, a structure may be used in which the gel-like member is formed by being covered by a member having a low frictional resistance when it contacts the end surface of the roller.

A description will be given hereinafter of a fluid floating on the above processing solution, for example, washing water and/or a stabilizing solution, or replenishing solution thereof.

A specific gravity of the processing solution or the replenishing solution is usually in the range of 1.030 to 1.100. In order that the fluid floats on the solution, the specific gravity of the fluid muse be lower than that of the processing solution or replenishing solution. The specific gravity of the floating fluid is preferably 1.080 or less, more preferably 1.000 or less, and most preferably 0.950 or less. The floating fluid may be used separately for the processing solution and the replenishing solution, or may be used for both of them at the same time. It is necessary that the above floating fluid forms a fluid layer and is not mutual soluble with and mixed with the processing solution and/or the replenishing solution. The water content of the fluid is preferably 10% by weight or less, more preferably 1% by weight or less, and most preferably 0.2% by weight or less. It is preferred that the above floating fluid does not evaporate. The boiling point of the fluid is preferably 100° C. or more, more preferably 150° C. or more, and most preferably 200° C. or more.

It is preferable that the above floating fluid does adversely affect on the processing properties of the photosensitive material by reacting with the processing solution or the replenishing solution and has a relatively low dielectric constant (a relative dielectric constant of approximately 2 to 20).

Concrete examples of the floating fluid include liquid-state saturated hydrocarbons such as paraffin, cycloparaffin, or the like; various synthetic oils such as phosphoric acid esters, phthalic acid esters, benzoic acid esters, substituent benzoic acid esters, lactate, fatty acid esters, benzyl alcohol esters, carbonic acid esters, or the like: ether compounds, active methylene compounds, alcohol compounds, and the like.

The following are concrete compounds, but the present invention is not limited to the same.

| | (specific gravity) | (boiling point) |
|---|---|---|
| (1) liquid paraffin | 0.881 | 300° C. or more |
| (2) nonane | 0.718 | 150° C. |
| (3) decane | 0.730 | 174° C. |
| (4) undecane | 0.740 | 196° C. |
| (5) dodecane | 0.749 | 216° C. |
| (6) tridecane | 0.757 | 234° C. |
| (7) tetradecane | 0.764 | 251° C. |
| (8) pentadecane | 0.769 | 268° C. |
| (9) $(C_4H_9O)_3P{=}O$ | 0.973 | 289° C. |
| (10) $(C_8H_{17}O)_3P{=}O$ (EH) | 0.920 | 185° C. |
| (11) $(\text{iso-}C_9H_{19}O)_3P{=}O$ | 0.909 | 220° C. |
| (12) 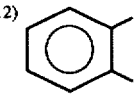 $COOC_8H_{17}(EH)$, $COOC_8H_{17}(EH)$ | 0.986 | 229° C. |
| (13) 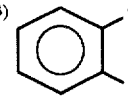 $COOC_{10}H_{21}(iso)$, $COOC_{10}H_{21}(iso)$ | 0.966 | 248° C. |
| (14) 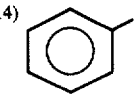 $COOC_5H_{11}(iso)$ | 0.984 | 260° C. |

-continued

| | (specific gravity) | (boiling point) |
|---|---|---|
| (15) 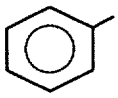 | 0.923 | 230° C. |
| (16) 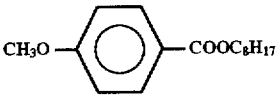 | 0.999 | 162° C. |
| (17) 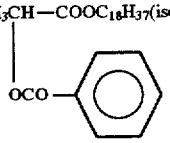 | 0.958 | 195° C. |
| (18) 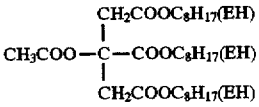 | 0.980 | 225° C. |
| (19) 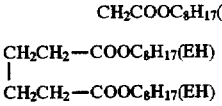 | 0.927 | 214° C. |
| (20) 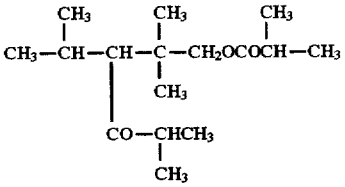 | 0.945 | 280° C. |
| (21) 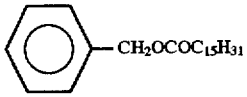 | 0.937 | 190° C. |
| (22) $C_{12}H_{25}O-\underset{\underset{O}{\parallel}}{O}-C_{12}H_{25}$ | 0.875 | 235° C. |
| (23) $C_{11}H_{23}CON(C_2H_5)_2$ | 0.862 | 175° C. |
| (24) 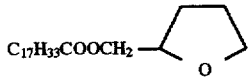 | 0.923 | 220° C. |
| (25) $CH_3COCH_2COOC_{12}H_{25}$ | 0.909 | 155° C. |
| (26) 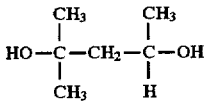 | 0.924 | 198° C. |
| (27) 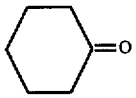 | 0.948 | 156° C. |
| (28) $[CH_3(CH_2)_3O]_3B$ | 0.853 | 230° C. |

EH means 2-ethylhexyl.

In the above-described compounds, the compounds of (1) to 8) are preferably used. Particularly, the liquid paraffin (1) has a high boiling point and a low water content, and is not mutual soluble with and mixed with the replenishing solution, and further does not react with components of the replenishing solution and does not have solubility for oil-soluble components in the replenishing solution, and still further has a row oxygen absorbing property and a low carbon-dioxide absorption property, which is very preferable.

The thickness of the above fluid layer is preferable in the range of about 0.1 to 20 mm. Further, it is preferable that the fluid layer is used together with a floating body disclosed in JP-A No. 61-258245.

It suffices that the photosensitive material preferably used in the present invention is constructed in that at least one light-sensitive layer is formed on a support thereof. A typical example of the photosensitive material is a silver halide photosensitive material having, on a support thereof, at least one light-sensitive layer formed of a plurality of silver halide emulsion layers which substantially have the same color sensitivity and which have different photosensitivities. The light-sensitive layer is a unit light-sensitive layer having color sensitivity to any one of blue light, green light and red light. In a multilayered silver halide color photosensitive material, generally, unit light-sensitive layers are arranged in order of a red sensitive layer, a green sensitive layer and a blue sensitive layer from the support side. However, the order of the light-sensitive layers being arranged may be reversed in accordance with the type of purposes for which they are used, or the order of a different color light-sensitive layer being disposed between layers having the same color sensitive regions may also be applied. Non-light sensitive layers may be respectively provided between the above silver halide light-sensitive layers, on the uppermost layer, and on the lowermost layer. These non-light sensitive layers may each include a coupler, a DIR compound, a color-mixture inhibitor, and the like, which will be described later. A plurality of silver halide emulsion layers forming each unit light-sensitive layer are, as disclosed in DE 1,121,470 or GB 923,045, preferably provided in that two layers i.e., a high sensitive emulsion layer and a low sensitive emulsion layer, are arranged in order in such a manner that light-sensitivity becomes lower toward the side of the support. Further, as disclosed in JP-A Nos. 57-112751, 62-200850, 62-206541, and 62-206548, a low sensitive emulsion layer may be provided on the side of a photosensitive material apart from the support and a high sensitive emulsion layer may be provided on the side of a photosensitive material near the support.

As a concrete example of the arrangement, the light-sensitive layers can be arranged in order of a low-sensitivity blue sensitive layer (BL), a high-sensitivity blue sensitive layer (BH), a high-sensitivity green sensitive layer (GH), a low-sensitivity green sensitive layer (GL), a high-sensitivity red sensitive layer (RH), and a low-sensitivity red sensitive layer (RL) from the side of the photosensitive material at which farthermost from the support, or can be arranged in order of BH, BL, GL, GH, RH, and RL, or in order of BH, BL, GH, GL, RL and RH.

Further, as disclosed in JP-B No. 55-34932, the light-sensitive layers may also be arranged in order of the blue sensitive layers, GH, RH, GL and RL from the side of the photosensitive material which is farthermost from the support. Moreover, as disclosed in JP-A Nos. 56-25738 and 62-63936, they may also be arranged in order of blue sensitive layers, GL, RL, GH and RH from the side farthermost from the support.

In JP-B No. 49-15495, there is shown a structure which is formed from three layers having different light-sensitivities, i.e., a silver halide emulsion layer whose light-sensitivity is highest is provided in an upper layer, a silver halide emulsion layer whose light-sensitivity is lower than that of the upper layer is provided in an intermediate layer and a silver halide emulsion layer whose light-sensitivity is lower than that of the intermediate layer is provided in a lower layer in such a manner that the light-sensitivities off the three layers become lower toward the side of the support. Even when the emulsion layer is formed from a three-layered structure with three layers having different light sensitivities, as disclosed in JP-A No. 59-202464, the emulsion layers may be arranged in order of a medium-sensitive emulsion layer, a high-sensitive emulsion layer and a low-sensitive emulsion layer from the side apart from the support in the layers having the same color-sensitive regions.

In addition, these emulsion layers may also be arranged in order of the high-sensitive emulsion layer, a low-sensitive emulsion layer and a medium-sensitive emulsion layer, or in order of the low-sensitivity emulsion layer, the medium-sensitive emulsion layer and the high-sensitive emulsion layer. Further, even when a structure of four layers or more is used, the arrangement of the layers of the four-layered structure may be changed as described above.

In order to improve color reproduction, a donor layer (CL) of an interimage effect, of which spectral sensitivity distribution is different from that of a main light-sensitive layer such as BL, GL, RL or the like and which is described in U.S. Pat. Nos. 4,668,271, 4,705,744, 4,707,486, and JP-A Nos. 62-160448 and 63-89850, is preferably disposed adjacent to or close to the main light-sensitive layer.

Silver halide which is preferably used in the present invention is silver iodobromide, silver iodochlorilde, or silver iodochlorobromide having silver iodide contents off about 30% by mole or less. Particularly, silver iodobromide or silver iodochlorobromide having silver iodide contents of about 2 to 10% by mole is preferably used.

A technique and inorganic/organic materials which can be used in the color photosensitive material of the present invention are described in European Patent No. 436,938A2 and other European Patents described below, and the related portions are described below.

1. Layer structure: page 146, line 34 to page 147, line 28
2. Silver halide emulsion: page 147, line 26 to page 148, line 12.
3. Yellow coupler: page 137, line 35 to page 146, line 33 and page 149, lines 21 to 23
4. Magenta coupler: page 149, lines 24 to 28: European Patent No. 421,453A1 (page 3, line 5 to page 25, line 55)
5. Cyan coupler: page 149, lines 29 to 33; European Patent No. 432,804A2 (page 3, line 28 to page 40, line 2)
6. Polymer coupler: page 149, lines 34 to 38: European Patent No. 435,334A2 (page 113, line 39 to page 123, line 37)
7. Colored coupler: page 53, line 42 to page 137, line 34 and page 149, lines 39 to 45
8. Other functional couplers: page 7, line 1 to page 53, Line 41 and page 149, line 46 to page 150, line 3;

European Patent No. 435,334A2 (page 3, line 1 to page 29; line 50)
9. Preservatives, Mildewproof agent: page 150, lines 25 to 28
10. Formaline scavenger: page 149, lines 15 to 17
11. Other additives: page 158, lines 38 to 47; European Patent No. 421,453A1 (page 75, line 21 to page 84, line 56 and page 27, line 40 to page 37, line 40
12. Dispersion method: page 150, lines 4 to 24
12. Support: page 150, lines 32 to 84
14. Coating thickness/coating properties: page 150, lines 35 to line 49
15. Color development process: page 150, line 50 to page 151, line 47
16. Desilverization process: page 151, line 48 to page 152, line 53
17. Automatic processing machine: page 152, line 54 to page 153, line 2
18. Washing/stabilizing process: page 153, lines 3 to 87.

Next, a color processing solution which is used in the present invention will be described.

The compounds described in JP-A No. 121739, page 9, upper right column, line 1 to page 11, lower left column, line 4 can be used for the color developing solution used in the present invention. As the color developing agent used, particularly, when rapid processing is effected, 4-amino-3-methyl-N-ethyl-N-(2-hydroxyethyl)aniline, 4-amino-3-methyl-N-ethyl-N-(3-hydroxypropyl)aniline, 4-amino-3-methyl-N-ethyl-N-(4-hydroxybutyl)aniline, and 4-amino-3-methyl-N-ethyl-N-[β-(methanesulfonamido)ethyl]aniline are preferable.

The above color developing agent is preferably used by the amount of 0.01 to 0.08 mole per 1 liter of the color developer, more preferably 0.015 to 0.06 mole, and most preferably 0.02 to 0.05 mole. The color developer replenisher preferably contains the color developing agent whose concentration is 1.1 to 3 times the concentration of the above color developer, and more preferably, the color developing agent whose concentration is 1.3 to 2.5 times the concentration of the color developer is contained.

Sulfite is used, for the color developer, as a tarring inhibitor of oxides of the color developing agent. The amount of sulfite is preferably used in the range of 0.01 to 0.05 mole/liter, more preferably 0.02 to 0.04 mole/liter. The concentration of sulfite used in the replenisher is preferably 1.1 to 3 times the concentration of the sulfite used in the color developer.

The pH value of the color developer is preferably in the range of 9.8 to 11.0, more preferably, 10.0 to 10.5. The pH value of the replenisher is preferably set in the range by 0.1 to 1.0 higher than the above range off the color developer. In order to stabilize and keep the pH in the above range, commonly-known buffers such as carbonates, phosphates, sulfosalicylates, borates, or the like is used.

The amount of the color developer replenisher is preferably 80 to 1,300 ml per 1 $m^2$ of the photosensitive material, and from the viewpoint of reduction in load of environmental pollution, it is preferably as small as possible. Concretely, it is more preferably 130 to 600 ml, and most preferably 130 to 520 ml.

The concentration of bromide ion in the color developer is usually in the range of 0.01 to 0.06 mole/liter, and in order to inhibit fogging while maintaining the sensitivity so as to improve discrimination, and to improve the graininess, it is preferably set in the range of 0.015 to 0.03 mole/liter. When the concentration of bromide ion is set in the above range, the bromide ion obtained by the following expression may simply be contained in the replenisher. However, it is preferred that, when C is negative, the bromide ion is not contained in the replenisher.

$$C=A-W/V$$

wherein,

C: concentration of bromide ion in the color developer replenisher (mole/liter);

A: target concentration of bromide ion in the color developer (mole/liter):

W: amount of bromide ion dissolved from the photosensitive material into the color developer when the photosensitive material of 1 $m^2$ is subjected to color development (mole)

V: amount of the color developer replenisher with respect to the photosensitive material of 1 $m^2$ (liter)

Further, when the amount of the replenisher is reduced, or when the concentration of the bromide ion is set higher, in order to increase the sensitivity, a development accelerator is preferably used, for example, pyrazolidones such as 1-phenyl-3-pyrazolidone and 1-phenyl-2-methyl-2-hydroxymethyl-3-pyrazolidone, thioether compounds such as 3,6-ditia-1,8-octanediol, and the like.

The processing solution of the present invention having a bleaching capability allows application of compounds and processing conditions described in JP-A No. 4-125558 (page 4, lower left column, line 16 to page 7, lower left column, line 6).

The bleaching agent, preferably, has a redox potential of 150 mV or more. As a concrete example, those described in JP-A Nos. 5-72694 and 5-178812 are preferable, and particularly, 1,3-diaminopropanetetraacetic acid, and the ferric complex salt in the compounds in Example 1 described in JP-A No. 5-173312 (page 7) are preferable.

In order to improve biodegradation properties off the bleaching agent, the ferric complex salt described in JP-A Nos. 4-251845, 4-268552, 6-208213, and EP Nos. 588,289 and 591,934 is preferably used as the bleaching agent. The concentrations of these bleaching agents are each preferably in the range of 0.05 to 0.8 mole per one liter of the solution having a bleaching capability, and more preferably 0.1 to 0.15 mole from the viewpoint of reducing the quantity of waste liquid. Further, when the solution having the bleaching capability is the bleaching solution, the bleaching solution may preferably have the bromide contents of 0.2 to 1 mole/liter, more preferably, 0.3 to 0.8 mole/liter.

A replenisher of the solution having the bleaching capacity basically contains concentrations of various components obtained by the following expression. As a result, the concentration of a mother liquid can be maintained constantly.

$$CR=CT\times(V1+V2)/V1+CP$$

wherein,

CR: concentration of components in the replenisher;

CT: concentration of components in the mother liquid (i.e., a solution in a processing tank);

CP: density of components consumed in the processing:

V1: amount of the replenisher having a bleaching capability per 1 $m^2$ of the photosensitive material (ml); and V2: amount of the solution carried over from the preceding bath by 1 $m^2$ of the photosensitive material (ml).

in addition, the bleaching solution, preferably, contains a pH buffer, and particularly, diccarbonic acids having a weak odor, such as succinic acid, maleic acid, malonic acid, glutaric acid, adipic acid, and the like are preferably contained. Further, a public-known bleaching accelerator described in JP-A No. 53-95830, RD No. 17129, and U.S. Pat. No. 3,893,858 is preferably used.

A bleach replenisher of 50 to 1,000 ml per 1 $m^2$ of the photosensitive material is preferably replenished to the bleaching solution, more preferably 80 to 500 ml, and most preferably 100 to 300 ml. Further, the aeration of the bleaching solution is preferably carried out.

The processing solution having a fixing capability allows application of compounds and processing conditions described in JP-A No. 4-125558 (on page 7, lower left column, line 10 to page 8, a lower right column, line 19).

Particularly, in order to improve a fixing speed and preservativity, the compounds respectively expressed by general formulae (I) and (II) of JP-A No. 6-301189 are preferably contained, singly or in combination, in the processing solution having the fixing capability. It is preferred that p-toluenesulfinic acid salt and sulfinic acid described in JP-A No. 1-224762 are preferably used from the viewpoint of improvement in preservativity.

It is preferred that, in order to improve desilvering characteristics, ammonium is used, as a cation, for the solution having the bleaching capability or the solution having the fixing capacity. However, in order to alleviate the environmental pollution, ammonium is preferably reduced or removed.

In a bleaching step, a bleaching/fixing step, and a fixing step, it is particularly preferred that get agitation described in JP-A No. 1-309059 is carried out.

The amount of the replenisher in the bleaching/fixing step or the fixing step is 100 to 1,000 ml per 1 $m^2$ of the photosensitive material, more preferably 150 to 700 ml, and most preferably 200 to 600 ml.

In the bleaching/fixing step or in the fixing step, is preferred that various silver recovery device is installed on an in line or off line to recover silver. By providing the silver recovery device on the in line, silver recovery processing can be effected with the silver concentration in the solution being reduced, thereby making it possible to reduce the amount of replenisher. Further, it is preferred that silver is recovered by the off line and the remaining solution is reused as a replenisher.

The bleaching/fixing step and the fixing step each can be effected by using a plurality of processing tanks, and each of the tanks is preferably formed of a multistage countercurrent type by cascade piping. From the viewpoint of the, relationship of the size between a developing machine and the tanks, a two-tank cascade structure is generally effective. The ratio of the processing time of a first tank to a subsequent tank is preferably in the range of 0.5:1 to 1:0.5, more preferably 0.8:1 to 1:0.8.

It is preferred that, from the viewpoint of improvement in preservativity, a free chelating agent which is not a metallic complex exists in the bleaching/fixing solution or in the fixing solution. As the chelating agent, a biodegradable chelating agent already described with respect to the bleaching solution is preferably used.

The amount of the replenisher of washing water and/or a stabilizing solution is preferably 130 to 800 ml per 1 $m^2$ of the photosensitive material, more preferably 150 to 700 ml, and most preferably 200 to 600 ml, which is the preferred range from the viewpoint of maintaining a washing or stabilizing function and reducing the amount of the waste solution for environmental conservation. In the processing carried out with the above amount of the replenisher, in order to inhibit propagation of bacteria or mildew, a public-known mildewproofing agent such as thiabendazole, 1,2-benzoisothiazoline-3-on, and 5-chloro-2-methylisothiazoline-3-on, an antibiotic substance such as gentamicin, water deionized by an ion exchange resin or the like, are preferably used. It is further effective that deionized water and the mildewproofing agent or the antibiotic substance are used together.

Further, the amount of the replenisher in the washing water and/or the stabilizing solution tank is preferably reduced by reverse osmosis membrane processing described in JP-A Nos. 3-46652, 3-53246, 3-55542, 3-121448, and 3-126030. In this case, the reverse osmosis membrane is preferably a low-pressure reverse osmosis membrane.

In this way, the amount of the replenisher for washing water and/or the stabilizing solution can be reduced remarkedly. On the other hand, in order to solve the problems in that propagation of bacteria occurs and generated floating substances stick to the photosensitive material due to an increase in residence time of water in the tank, a method for reducing an amount of calcium ion and magnesium ion described in JP-A No. 62-288,838 can be used extremely effectively. Further, there can also be used a chlorine-containing germicides such as isothiazolone compounds, thiabendazoles, sodium chlorinated isocyanurate, or the like, described in JP-A No. 57-8,542, other benzonriazoles, germicides described in "Chemistry of Germicidal/Antifungal Agent" (by Hiroshi Horiguchi , Sankyo Pub. Co., 1986) , "Sterilization/Disinfection/Antifungal Technique" (edited by Sanitary Technique Society Pub., 1982), "Encyclopedia of Antibacterial and Anti fungal Agents" (edited by Nippon Antibacterial/Antifungal Society, 1986), and the like.

The processing temperatures of the washing water and the stabilizing solution used in the present invention is in the range of 15° C. to 45° C., preferably 20° C. to 40° C. The total processing time of the washing and stabilizing process is 15 to 60 seconds, preferably 15 to 50 seconds.

Particularly, when the water and stabilizing process is effected with the latter preferred processing time of 15to 50 seconds, the effects of the present invention can be effectively exhibited.

Further, the photosensitive material of the present invention can be directly processed with the stabilizing solution, in place of the washing water. In this stabilizing process, public-known methods described in JP-A Nos. 57-8543, 58-14834, and 60-220345 can be all used.

Further, the stabilizing solution contains a compound which stabilizes a dye image, for example, formalin, benzaldehydes such as m-hydroxybenzaldehyde, formaldehyde bi-sulfurous acid adduct, hexamethylenetetramine and its derivatives, hexahydrotriazine and its derivatives, dimethylolurea, N-methylol compound such as N-methylolpyrazole, organic acid, pH buffer, and the like. The preferred amount of each of these compounds added is in the range of 0.001 to 0.02 mole per liter of the stabilizing solution, and each of these compounds can be added within the above range of the salt concentration. It is preferred that the concentration of free formaldehyde in the stabilizing solution is low, which decreases scattering of formaldehyde gas. For this reason, as a dye image sabilizer, m-hydroxybenzaldehyde, hexamethylenetetramine, N-methylolazoles described in JP-A No. 4-270344 such as N-methylolpyrazole, azolylmethylamines described in JP-A No. 4-313753 such as N,N'-bis(1,2,4-triazole-1-ilmethyl) piperazine, and the like are preferably used. Particularly, azoles such as 1,2,4-triazole described in JP-A No. 4-359249 (corresponding to European Patent Application Laid-Open No. 519190A2), and azolylmethylamine such as 1,4-bis(1,2,4-triazole-1-ilmethyl)piperazine, and is derivatives are preferably used together because of high image stability and low formaldehyde vapor pressure. In the present invention, it is preferred, from the viewpoint of maintaining a low salt concentration, that the image stabilizer is not added.

In addition, ammonium compounds such as ammonium chloride and ammonium sulfite, metal compounds such and Al, a fluorescent whitening agent, a hardening alcanol amine described in U.S. Pat. No. 4,786,583, preservatives which can be contained in the above fixing solution or bleaching/fixing solution, for example, sulfinic acid compounds described in JP-A No. 1-231051, can be added when necessary.

In order to prevent generation of unevenness due to water when the photosensitive material after processed is dried, various surface active agents can be contained in the washing water and/or the stabilizing solution. Particularly, nonionic surface active agents are preferably used, and an alkylphenolethyleneoxide adduct is more preferable. As the alkylphenols, octyl, nonyl, dodecyl, dinonylphenol are particularly preferable. Further, molar number of addition of ethyleneoxide is preferably in the range of 8 to 14. Moreover, a silicone surface active agent having an anti-foaming function may also be preferable.

Various chelating agents can be contained in the washing water and/or the stabilizing solution. Preferable examples of chelating agents are aminopolycarbonic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid, diethylenetriamine-N,N,N',N'-tetramethylenephosphonic acid, a hydrolysis product of maleic anhydride polymer described in European Patent No. 345,172A1, and the like.

An overflow solution accompanying the replenisher of the above washing water and/or stabilizing solution can be reused in other processes such as a desilverization process and the like.

In the processing using an automatic processing machine or the like, when each of the processing solutions is evaporated to be brought into a concentrated state, it is preferable to replenish a proper amount of water, compensating solution, or replenisher so as to compensate for the concentration caused by evaporation. A concrete method for replenishment of water is not particularly limited. Among various methods, a method in which a monitor (water) tank is provided independently of a bleaching tank, an amount of evaporation of water in the bleaching tank is calculated from an amount of evaporation of water in the monitor tank, and water is replenished in the bleaching tank in proportion to the amount of evaporation of water in the bleaching tank, which is described in JP-A Nos. 1-254959 and 1-254960, and an evaporation-correcting method using a fluid level sensor or an overflow sensor which is described in JP-A Nos. 3-248155, 3-249644, 3-249845, and 3-249646 are preferable. As the water for compensating for an amount of evaporation of each processing solution, water from a water service may be used, but preferably, deionized water or sterilized water which is preferably used in the above washing process may be used.

Further, in order to diminish adhesion of dust to a magnetic recording layer coated on the photosensitive material, the stabilizing solution described in JP-A No. 6-289559 is preferably used.

In the processing in the present invention, it is particularly preferred that an evaporation correcting operation of processing solutions which is described in Kokai Gibe (Laid-Open Technical Report) No. 94-4992 (published by Japan Institute of Invention and Innovation). In particularly, it is more preferable to use a method of correcting evaporation, based on the equation-1 on page 2 in the above technical report, by using temperature and humidity information in an environment in which the developing machine is installed. Water used for correcting evaporation may be preferably obtained from a replenisher tank for washing water. In this case,preferably used a preferably used as the washing water-replenisher.

As processing chemicals used in the present invention, those described in the above technical report, page 3, right column, line 15 to page 4, left column, line 32 are preferable.

Further, as a processing machine in which the above processing chemicals are used, a film processor described in the above technical report, page 3, right column, Lines 22 to 28 is preferably used.

Respective concrete examples of processing chemicals, an automatic processing machine, and evaporation correcting method which are preferably used to achieve the present invention are described in the above technical report, page 5, right column, line 11 to page 7, right column, the bottom line.

The photographic processing apparatus, generally, includes a developing tank, fixing tank and washing tank. The processing apparatus for a color photosensitive material, basically, includes a color developing tank, bleaching tank, fixing tank and washing tank, and in place of the washing tank, the stabilizing tank may be used or the washing tank and the stabilizing tank both may be used. Further, the bleaching tank and the fixing tank may be replaced by a bleaching/fixing tank. Further, a middle washing tank, a first developing tank, and the like may also be provided. Moreover, respective replenisher tanks of the above tanks, solution-conveying means and the like are provided.

The photographic processing apparatus also includes photosensitive-material conveying means, photosensitive-material drying means, and the like.

Next, a magnetic recording layer used in the present invention will be described.

The magnetic recording layer used in the present invention is made by coating, on a support, an aqueous coating solution or coating solution containing an organic solvent in which magnetic particles are dispersed in a binder.

The magnetic particles used in the present invention includes ferromagnetic ferric oxide such as $\gamma$ $Fe_2O_3$, Co deposited $\gamma$ $Fe_2O_3$, Co deposited magnetite, magnetite containing Co, ferromagnetic chromium dioxide, ferromagnetic metal, ferromagnetic alloy, hexagonal-system Ba ferrite, Sr ferrite, Pb ferrite, Ca ferrite and the like. In particular, Co deposited ferromagnetic iron oxide such as Co deposited $\gamma$ $Fe_2O_3$ and the like is preferred. The magnetic particle in the form of a needle, a rice grain, a ball, a cubic, a plate shape and the like can be used. The specific surface area of the particle is preferably more than 20 $m^2/g$, more preferably more than 30 $m^2/g$ in SBET. The saturation magnetization ($\sigma s$) of the ferromagnetic body is preferably 3.0×104 to 3.0×105 A/m, more preferably 4.0×104 to 2.5×105 A/m. The ferromagnetic particle may be surface-treated with silica and/or alumina, or an organic material. Further, the surface of the magnetic particles may be treated with a si lane coupling agent or a titan coupling agent as described in JP-A No. 6-161032. The magnetic particle covered by an inorganic material or an organic material can also be used as described in JP-A No. 4-259911 and JP-A No. 5-81652.

As a binder used for dispersing the magnetic particles, thermoplastic resins, thermosetting resins, radiation hardening resins, reactive resins, acid-degradable polymers, alkali-degradable polymers, bio-degradable polymers, natural polymers such as cellulose derivatives, saccharide derivatives and the like, and the mixture thereof can be used which are described in JP-A No. 4-219569. Tg of these resins is −40° C. to 300° C., and the weight-average molecular weight of these resins is 2,000 to 1,000,000. These resins and polymers include vinyl copolymers, cellulose derivatives such as cellulose diacetate, cellulose triacetate, cellulose acetate propionate, cellulose acetate butyrate, cellulose tripropyonate, acrylate resins and polyvinyl acetal resins. Gelatin can also preferably be used. In particular, cellulose diacetate and cellulose triacetate are preferred. The binders can be cured by adding cross-linking agents such as an epoxy type, an aziridine type and an isocyanate type. The cross-linking agents of the isocyanate type include tolylene diisocyanate, 4,4'-diphenylmethane diisocyanate, hexamethylene diisocyanate and xylylene diisocyanate, reaction products between the isocyanates and polyalcohols such as the reaction product between 3 mole of tolylene diisocyanate and 1 mole of trimethylol propane, and polyisocyanates formed by condensation of these isocyanates as described in JP-A No. 6-59357.

The aforementioned magnetic particles are dispersed in the binder by use of a kneader, a pin type mill, an annular type mill and the like, as described in JP-A No. 6-35092. Two or more of these devices can be used. Dispersants described in JP-A No. 5-88283 and other known dispersants can be used. The thickness of the magnetic recording layer is 0.1 μm to 10 μm, preferably 0.2 μm to 5 μm, more preferably 0.3 μm to 3 μm. The weight ratio of the magnetic particles to the binder is preferably 0.5:100 to 60:100, more preferably 1:100 to 30:100. The coating amount of the magnetic particles are in the range of 0.005 to 3 $g/m^2$, preferably in the range of 0.01 to 2 $g/m^2$, more preferably 0.02 to 0.5 $g/m^2$. The transmission density of yellow color of the magnetic recording layer is preferably in the range of 0.01 to 0.50, more preferably 0.03 to 0.20, and most preferably 0.04 to 0.15. The magnetic recording layer can be provided on the back surface of a support of a photographic material over the entire surface or in a stripe form by means of coating or printing. The magnetic recording layer are coated on the support by various coating methods such as an air doctor coating, a blade coating, an air knife coating, a squeezing coating, an immersion coating, a reverse roller coating, a transfer roller coating, a gravure coating, a kiss roll coating, a case coating, a spray coating, a dip coating, a bar coating, an extrusion coating and the like. A coating solution disclosed in JP-A No. 5-341438 or the like can preferably used.

The magnetic recording layer can have functions such as improved lubrication, curling behavior control, electrostatic charge prevention, adhesion prevention, magnetic head grinding and the like. Alternatively, another layer having these functions may be provided. A grinding agent in which at least one type of particles is non-spherical inorganic particles having a hardness of 5 or more in Mobs' scale. The non-spherical inorganic particles are preferably fine powder of oxides such as aluminum oxide, chromium oxide, silicon dioxide, titanium dioxide, and the like, carbides such as silicon carbide, titanium carbide and diamond and the like. The surface of these grinding agents may be treated with a silane coupling agent or a titanium coupling agent. These particles may be added to the magnetic recording layer or an overcoating layer (such as a protective layer and a lubricating layer) on the magnetic recording layer. The aforementioned binders can be used in the overcoating layer, and the same binder as that of the magnetic recording layer is preferred. Photosensitive materials having the magnetic recording layer are disclosed in U.S. Pat. Nos. 5, 336,589, 5,250,404, 5,229,259, 5215,874 and EP No. 466,130.

A description of polyester supports used in the present invention will be given hereinafter. However, details including photosensitive materials, processings, cartridges and embodiments are described in Kokai Giho (Laid-Open Technical Report) No. 94-6028 (Published by Japan Institute of Invention and Innovation on Mar. 15, 1994). The polyesters used in the present invention are formed with diols and aromatic dicarboxylic acids as essential components. The aromatic dicarboxylic acids are 2,6-naphthalenedicarboxylic acid, 1,5-naphthalenedicarboxylic acid, 1,4-naphthalenedicarboxylic acid, 2,7-naphthalenedicarboxylic acid, telephthalic acid, isophthalic acid and phthalic acid. The diols are diethyleneglycol, triethyleneglycol, cyclohexanedimethanol, bisphenol A and bisphenol. The polymers are homopolymers such as polyethyleneterephthalate, polyethylenenaphthalate, polycyclohexanedimethanol telephthalate and the like. Preferred polymers are a polyester containing 50% by mole to 100% by mole of 2,6-naphthalenedicarboxylic acid. The most preferred polymer is polyethylene 2,6-naphthalate. Average molecular weight is approximately in the range of 5,000 to 200,000. The Tg value off the polyesters used in the present invention is more than 50° C., preferably more than 90° C.

The polyester support is preferably treated with heat at a temperature between 40° C. and Tg, more preferably at a temperature between T-20° C. and Tg so as to prevent a trained curl behavior of the support. A heat treatment can be performed at a temperature in the above temperature range or during cooling the support. The period of time for the heat treatment is 0.1 to 1,500 hours, preferably 0.5 to 200 hours. The support may be treated with heat in a rolled state of the support, or, in a web state during conveying the support. The surface of the support may be toughened, for example, by applying electroconductive inorganic fine particles such as $SNO_2$, $Sb_2O_5$, or the like on the surface of the support to improve the surface characteristics. It is preferred that the edges of the support in the transverse direction are knurled to be higher than the other portion of the support so that transfer of the edge shape in the core portion off the roll of the support is prevented. The heat treatment can be carried out at any step after the support is made to be layered, the surface of the support is treated, a back layer containing an electrostatic charge preventing agent, a lubricating agent and the like is coated on the back surface of the support, and an undercoat layer is coated. However, it is most preferable that the heat treatment is carried out after coating of the electrostatic charge preventing agent.

An ultraviolet ray absorbing agent may be incorporated into the polyester. Further, in order to prevent light piping, commercially available dyes or pigments for polyester use such as Diraesin manufactured by Mitsubishi Kasei, Kayaset manufactured by Nippon Kayaku, and the like may be incorporated into the polyester.

In the present invention, the surface of the support is treated to adhere the photosensitive layers onto the support. The treatment includes the surface activating treatment such as a chemical treatment, a mechanical treatment, a corona discharge treatment, a flame treatment, an ultraviolet ray irradiating treatment, a high-frequency treatment, a glow discharge treatment, an active plasma treatment, a laser treatment, a mixed acid treatment, an ozone oxidation treatment and the like. The ultraviolet ray irradiating treatment, the flame treatment, the corona discharge treatment and the glow treatment are preferred surface treatments.

The subbing layer may be either a single layer or two layer or more. Binders for the subbing layer include copolymers made from monomers selected from the group of vinyl chloride, vinylidene chloride, butadiene, methacrylic acid, acrylic acid, itaconic acid, maleic acid anhydride as starting materials, as well as polyethyleneimine, epoxy resins, grafted gelatin, nitrocellulose and gelatin. Compounds for swelling the support include resorcin and p-chloro-phenol. Gelatin hardeners for the subbing layer are chromates such as chrome alum or the like, aldehydes such as formaldehyde, glutaraldehyde, or the like, isocyanates, active halogen compounds such as 2,4-dichloro-6-hydroxy-S-triazine, or the like, epichlorohydrinc resin, active vinyl-sulfone compounds and the like. The subbing layer may contain $SiO_2$, $TiO_2$, inorganic fine particles or fine particles of polymethylmethacrylate copolymer (0.01 μm to 10 μm in diameter) as a matting agent.

An electrostatic charge preventing agent is preferably used in the present invention. The electrostatic charge preventing agents include carboxylic acids, salts of carboxylic acids, polymers containing sulfonic acid salts, cationic polymers and ionic surfactants.

The electrostatic charge preventing agents can be at least one of crystalline metal oxides selected from the group of ZnO, $TiO_2$, $SnO_2$, $Al_2O_3$, $In_2O_3$, $SiO_2$, MgO, BaO, $MoO_3$ and $V_2O_5$, which have a volume resistivity of less than 107 Ω cm, more preferably less than 105 Ω cm and particle diameter of 0.001 to 1.0 μm, or fine particles of composite oxides (Sb, P, B, In, S, Si, C, and the like) with these metal oxides. Further, the metal oxides in a sol state or fine particles of composite oxides Thereof can be used. These metal oxides or the composite oxides can contain in the photosensitive material in the range of 5 to 500 mg/m$^2$, more preferably 10 to 350 mg/m$^2$. The ratio of the amount of the electroconductive crystalline oxides or composite oxides to the amount of the binder is 1/300 to 100/1, preferably 1/100 to 100/5.

The photosensitive material which is used in the present invention has preferably lubricating characteristics. The layers containing lubricants may be provided both on the side of the photosensitive layers and the back side of the photosensitive material. As lubricating characteristics, the coefficient of dynamic friction is preferably in the range of 0.01 to 0.25. The coefficient of dynamic friction was measured when the photosensitive material was relatively moved with respect to a stainless steel ball of 5 mm in diameter at a speed of 60 cm/min. at 25° C. and 60% relative humidity. In this test, when the photosensitive layer is used in place of the stainless steel ball, approximately the same value is obtained.

The lubricating agents which can be used in the present invention are polyorganosiloxanes, higher fatty acid amides, metal salts of higher fatty acids, esters of higher fatty acids and higher alcohols. The polyorganosiloxanes include polydimethylsiloxane, polydiethylsiloxane, polystyrylmethylsiloxane, polymethylphenylsiloxane, and the like. The layer into which the lubricating agents can be added are preferably the outermost layer of the emulsion layers or the back layer. Polydlmethyisiloxane and esters having long chain alkyl groups are partlcularly preferred.

It is preferable that the photosensitive material which can be used in the present invention contains a matting agent. The marring agent can be added to the emulsion side or the reverse side of the photosensitive material. However, it is particularly preferred that the matting agent is added to the outermost layer of the emulsion layers. The matting agent can be either soluble or insoluble in the processing solution. However, it is preferable that both the soluble and insoluble matting agents are used together. As the matting agents, for example, particles of polymethylmethacrylate, poly (methylmethacrylate/methacrylic acid=9/1 or 5/5 (molar ratio)), polystylene and the like are preferred. The diameters of the particles are preferably in the range of 0.8 to 10 μm, and a narrower distribution of the diameters is preferred. More than 90% of the total number of particles are preferably contained in the range of 0.9 to 1.1 times of an average diameter of the particles. In order to enhance the matting function, it is preferred to add fine particles having a diameter of 0.8 μm or less in addition to the above-described particles. For example, polymethylmethacrylate particles having a diameter of 0.2 μm, poly(methylmethacrylate/methacrylic acid=9/1. (molar ratio)) having a diameter or 0.3 μm, polystylene particles having a diameter of 0.25 μm, colloidal silica having a diameter of 0.03 μm can be added together.

A film cartridge which is used in the present invention will be described hereinafter. A main material of the cartridge used in the present invention may be either metal or plastics.

The preferred plastic material includes polystyrene, polyethylene, polypropylene, polyphenylether, and the like. Further, the cartridge used in the present invention may contain various electrostatic charge preventing agents, and carbon black, metallic-oxide particles, nonion, anion, cation, betainic surfactants, or polymers and the like can be preferably used. The cartridge subjected to electrostatic charge preventing treatment is described in JP-A Nos. 1-312537 and 1-812588. Particularly, resistance at 25° C. and 25% relative humidity is preferably 1,012 Ω or less. The plastic cartridge is usually manufactured by using plastics in which carbon black or pigments is incorporated to provide light-shading properties. The size of the cartridge may be in 188 magazines as currently used. In order to make a camera smaller, it is effective that the diameter of the cartridge in 135 magazines be changed from 25 mm to 22 mm or less. The capacity of a cartridge case is 30 $cm^3$ or less, more preferably 25 $cm^3$ or less. The weight off plastics used for the cartridge and the cartridge case is preferably in the range of 5 g to 15 g.

In addition, the cartridge used in the present invention, in which a film is pulled out by a spool being rotated, may also be used. Further, a structure in which a leading end of a film accommodated in a cartridge main body is pulled out from a port portion of the cartridge by a spool shaft being rotated in a direction in which a film is pulled out may also be applied. These cartridge structures are described in U.S. Pat. Nos. 4,834,306 and 5,226,613. A photographic film which is used in the present invention may be either a so-called unused film before development or a developed photographic film. Further, the unused film and the developed photographic film both may be accommodated in the same new cartridge, or may be accommodated in different cartridges.

As the cartridge which can be used in the present invention, structures described in U.S. Pat. Nos. 4,848,893, 5,317,355, 5,347,334, 5,296,886, and JP-A No. 6-85128 are preferable.

Preferred structures of a camera used for photographing by using the photosensitive material of the present invention will be described as follows: a simple loading structure described in JP-A Nos. 6-8886 and 6-99908; an automatic take-up structure described in JP-A Nos. 6-57398 and 6-101135: a film take-out function halfway through photographing described in JP-A No. 6-205690; a print aspect ratio selecting/recording function described in JP-A Nos. 5-293138 and 5-283382; a double exposure preventing function described in JP-A No. 6-101194; and a use-condition indicating function described in JP-A No. 5-150577.

Preferred examples of laboratory processing and laboratory equipment which can be used in the present invention will be described as follows: a system using a magnetic recording function described in JP-A Nos. 6-95265 and 4-123054, U.S. Pat. Nos. 5,034,838 and 5,041,933; a mechanism which allows selection of a print aspect ratio described in JP-A No. 5-19364; an information printing function for a printer described in JP-A Nos. 2-184835, 4-186335, 6-79968; an index-print function described in JP-A Nos. 5-11353 and 5-232594; an attach/detach function described in JP-A No. 6-148805; a splicing function described in JP-A No. 5-119461; and a cartridge-magazine function described in JP-A Nos. 4-346346 and 5-19439.

A photosensitive material processing apparatus according to the present invention will be hereinafter described in detail on the basis of embodiments described below, but the present invention is not limited to the embodiments.

(First Embodiment)

FIG. 1 shows a washing water and/or stabilizing solution processing section 12 of an automatic processing apparatus 10 which is a photosensitive material processing apparatus to which the present invention is applied. In the automatic processing apparatus 10, after an elongated negative film (hereinafter referred to as "film 14") as an example of the photosensitive material has been processed by the processing section 12, the processing of the film 14 is completed by being dried by an unillustrated drying section which is provided at a downstream side of the processing section 12.

Figure 2:
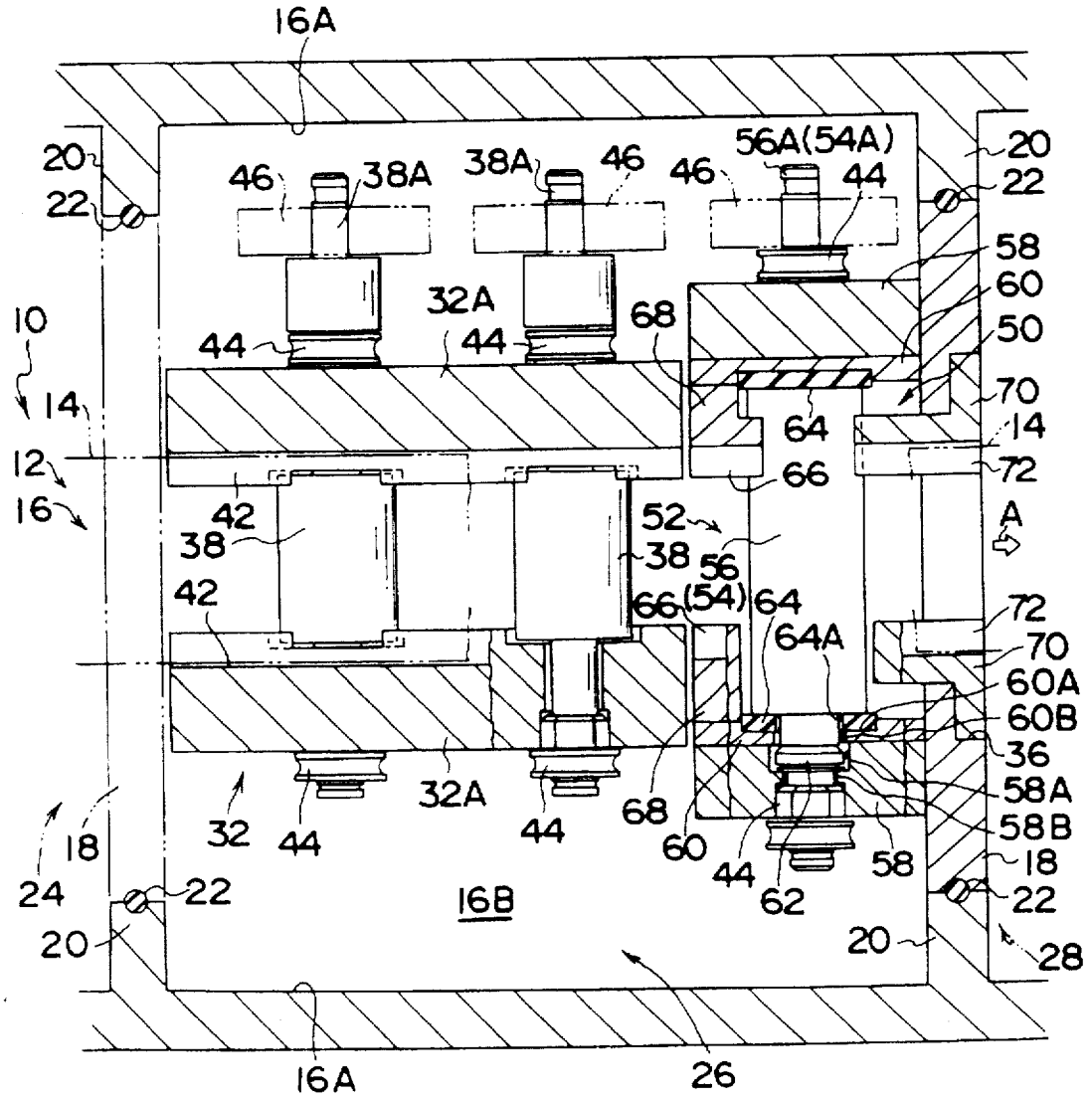
FIG. 2 is a cross-sectional view of a part of an interior of a processing section, taken along a direction in which a film is conveyed.
Figure 3:
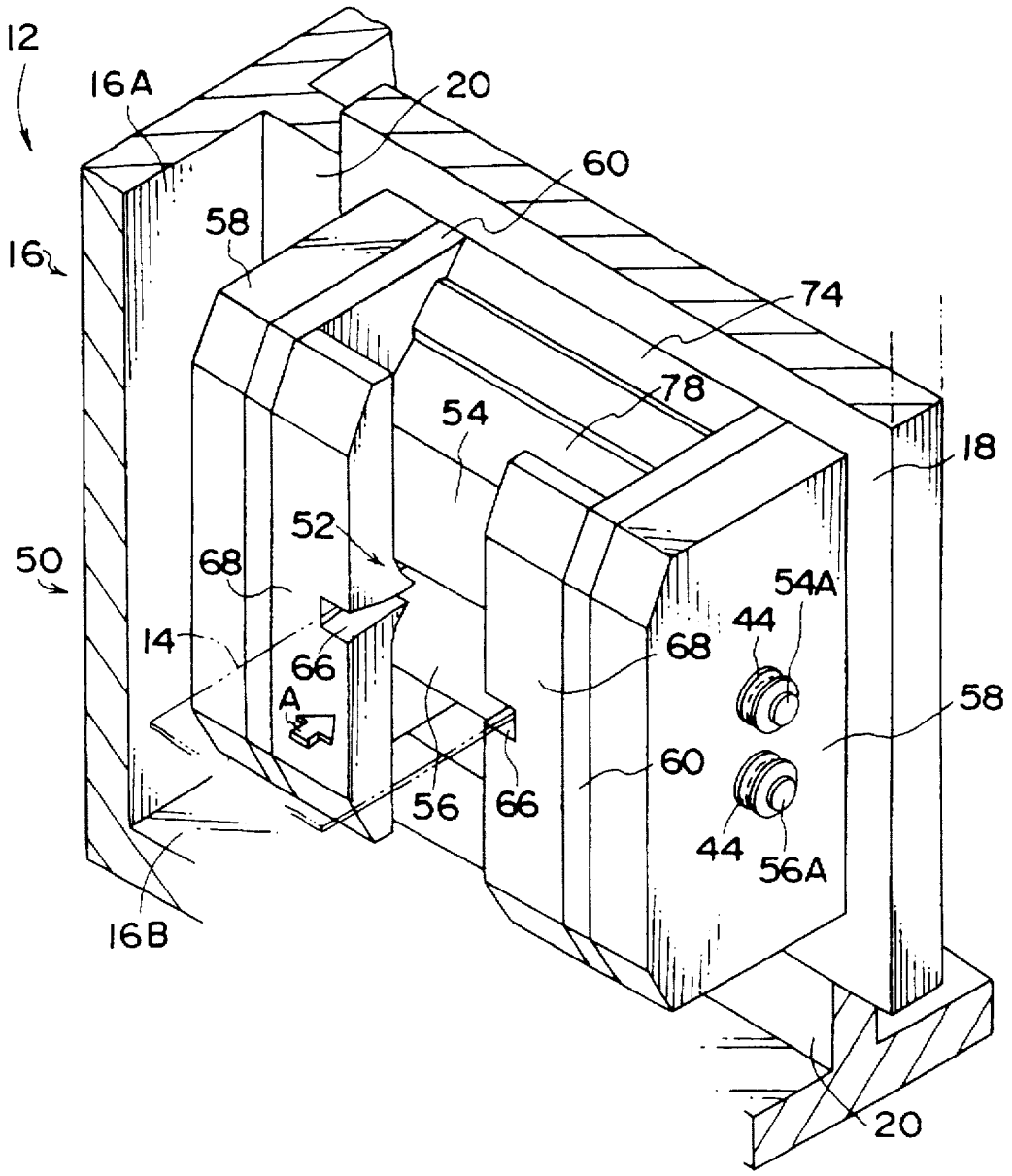
FIG. 3 is a schematic perspective view of a partition rack.

The washing water and/or stabilizing solution processing section 12 of the automatic processing apparatus 10 includes a washing and/or stabilizing processing tank unit 16. The processing tank unit 16 is provided with a plurality of partition plates 18 each serving as a partition of the processing tank unit 16. As shown in FIGS. 1 and 2, ribs 20 are formed within the washing and/or stabilizing processing tank unit 18 so as to project from a side wall 16A and a bottom plate 16B. The processing tank unit 16 is divided in such a manner that the partition plates 18 are fitted by the ribs 20 in substantially rectangle-shaped openings formed along an internal surface of the processing tank unit 16. A sealing member 22 is interposed between each one of the ribs 20 and the partition plates 18 so that subdivided portions of the processing tank unit 16 divided by the partition plates 18 are each tightly sealed.

Separated portions of the washing and/or stabilizing processing tank unit 16 divided by the partition plates 18 are formed as a first washing (stabilizing) tank 24, a second washing (stabilizing) tank 28, and a third washing (stabilizing) tank 28 which are arranged in order along a direction in which the film 14 is conveyed (i.e., the direction indicated by arrow A in FIG. 1).

The first washing (stabilizing) tank 24, the second washing (stabilizing) tank 28, and the third washing (stabilizing) tank 28 in the processing section 12 respectively include conveying racks 80, 32, 34 for conveying the film 14. A rectangle-shaped insertion opening 36 through which the film 14 passes is formed in each of the partition plates 18.

The conveying rack 30 within the first washing (stabilizing) tank 24 is provided with a plurality of conveying rollers 38 between a pair of rack side plates 30A. The film 14 inserted from an upper side of the conveying rack 30 by insertion rollers 40 which are provided above the first washing (stabilizing) tank 24 is conveyed toward the insertion opening 36 of the partition plate 18 while being bent into a substantially L-shaped configuration.

The conveying rack 32 within the second washing (stabilizing) tank 26 includes a conveying path for conveying the film 14 linearly from the insertion opening of the partition plate 18 at the side of the first washing (stabilizing) tank 24 to the insertion opening 36 of the partition plate 18 at the side of the third washing (stabilizing) tank 28 by a plurality of conveying rollers 38 provided between a pair of rack side plates 32A. Further, the conveying rack 34 within the third washing (stabilizing) tank 28 includes a conveying path for conveying the film 14 from the insertion opening 36 of the partition plate 18 in an obliquely upward direction by a plurality of conveying rollers 38 provided between a pair of rack side plates 34A.

For this reason, the film 14 inserted into the automatic processing apparatus 10 by the insertion rollers 40 is not taken out from a processing solution each of the processing tanks and is conveyed while being nipped by the conveying rollers 38. After immersed in respective processing solutions, the film 14 is conveyed out from the third washing (stabilizing) tank 28. The film 14 conveyed out from the third washing (stabilizing) tank 28 is conveyed to a drying section while water on the surface of the 14 is being squeezed off by unillustrated squeeze rollers or the like.

A guide groove 42 is formed along the conveying path the film 14 between each pair of rack side plates 30A, 32A, 34A in the conveying racks 30, 32, 34. As shown in FIG. 2, the guide groove 42 is provided to face non-image portions at transverse-direction ends of the film 14 conveyed by the conveying rollers 38. FIG. 2 shows a cross section of the second washing (stabilizing) tank 26 taken along the direction in which the film is conveyed.

The film 14 is guided along a predetermined conveying path by being conveyed with both transverse-direction ends of the film 14 being inserted in the guide groove 42. Namely, in the automatic processing apparatus 10, leaderless conveying of the elongated film 14 is effected.

Each of the conveying rollers 38 is rotatably supported by each pair of the rack side plates 30A, 32A, 34A via bearings 44 and force for nipping the film 14 is provided for the conveying roller 38 by an unillustrated coil spring or the like, which is interposed between the bearings 44 of opposing conveying rollers 38. Further, driving force is transmitted from an unillustrated identical drive source to the conveying roller 38 via a gear 46 provided on a rotating shaft 38A projecting from each of the rack side plates 30A, 32A, 34A, and the conveying roller 38 is thereby rotated.

As shown in FIGS. 1 and 2, a partition on rack 50 which faces the insertion opening 32 is provided in each of the partition plates 18 at the upstream side of the conveying direction of tile film 14. The partition rack 50 is provided with a roller pair 52 for flipping and conveying the film 14. The roller pair 52 is constructed in that upper and lower rollers 54, 56 thereof are provided between a pair of rack side plates 58 projecting from both sides of the insertion opening 36 in the transverse direction thereof. Through holes 58A are formed in each of the pair of rack side plates 58 at a predetermined interval. Rotating shafts 54A, 56A of the rollers 54, 56 are inserted into the through holes 58A and are rotatably supported by the through holes 58A via the bearings 44.

Further, a gear 46 is provided in each of the rotating shafts 54A, 56A projecting from one of the rack side plates 58 and rotates integrally with each of the rotating shafts 54A, 56A by driving force transmitted from the same drive source as the conveying rollers 38 and the film 14 is thereby nipped and conveyed by the roller pair 52. Meanwhile, in is preferred that the rollers 54, 56 each are relatively soft rubber rollers having a hardness of 30° to 50°. As a result, when the film 14 is nipped by the rollers 54, 56, the surface of the film 14 is not damaged and any unnecessary clearance is not formed between the film 14 and the rollers, thereby making it possible to improve airtight properties of the rollers between an upstream-side tank and a downstream-side tank.

Figure 4:
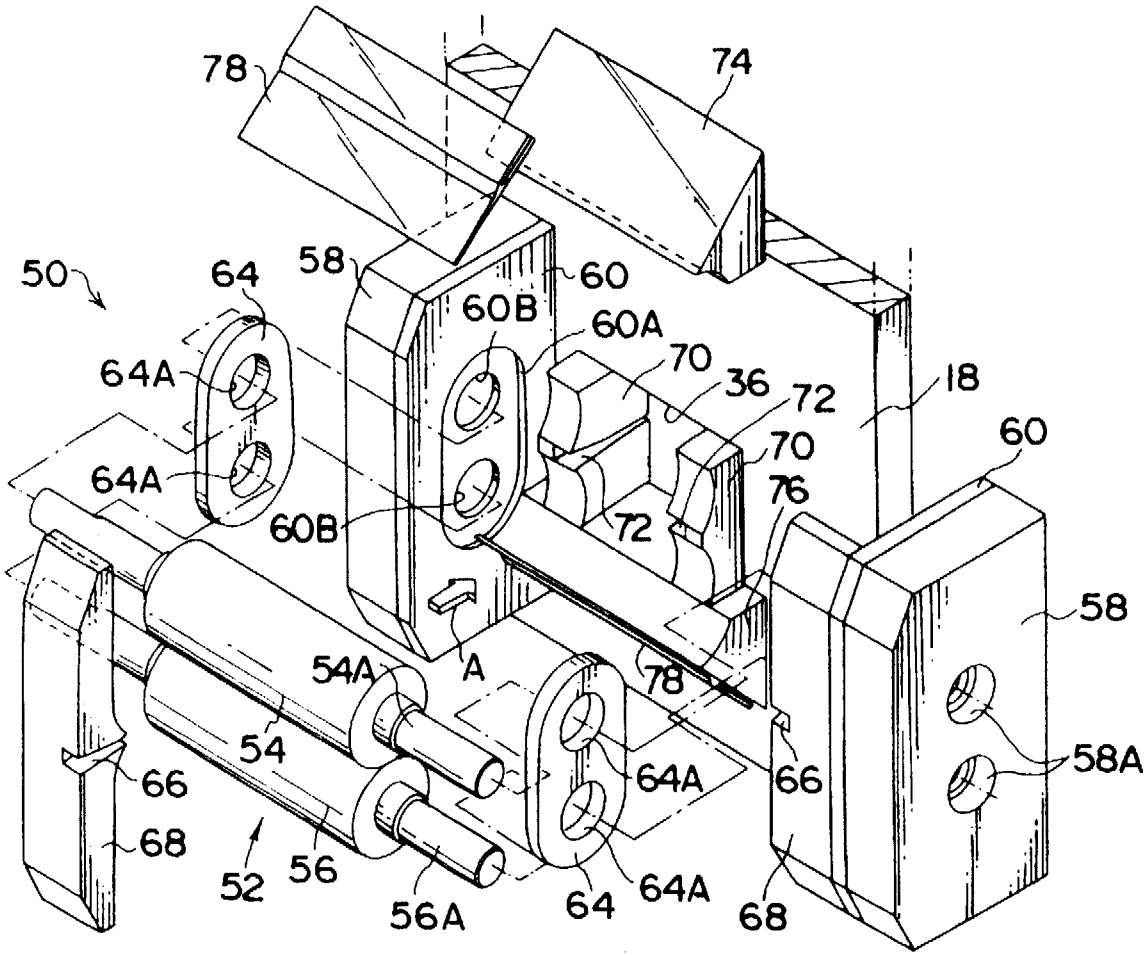
FIG. 4 is an exploded perspective view showing a schematic structure of a partition rack.

As shown in FIGS. 2 and 4, auxiliary side plates 60 are provided on the pair of rack side plates 58 at the sides thereof facing each other. An oblong recessed portion 60A of which longitudinal direction coincides with the vertical direction is formed in each of the auxiliary side plates 60. Through holes 60B each off which diameter is smaller than that of the through hole 58A off the rack side place 58 are formed within the recessed portion 60A. The auxiliary side plate 60 is provided in such a manner that the through hole 60B is formed to be concentrical with the through hole 58A of the rack side plate 58. Further, the recessed portion 60A of the auxiliary side plate 60 has a major-axis diameter slightly larger than that the outside dimension of the rollers 54, 56 and is formed in the shape of the circular recessed portions formed to be concentrical with the through holes 60B being connected together.

The roller pair 52 is mounted with the rotating shafts 54A, 56A of the rollers 54, 56 being inserted from the through holes 80B of the auxiliary side plates 60 into the through holes 58A of the rack side plates 58. As shown in FIG. 2, a small diameter portion 58B is formed within the through hole 58A of the rack side plate 58 and a chemically resistant sealing 82 (see FIG. 2) is provided within the small diameter portion 58B. The sealing 62 tightly abuts against the peripheral edge portion of the small diameter portion 58B together with the rotating shafts 54A, 56A. With in the through hole 58A of tile rack side plate 58, flowing of the processing solution is stopped by the sealing 62, thereby preventing processing solutions in vicinities of the outer surface of the rack side plate 58 and the inner surface of the auxiliary side plate 60 from mixing with each other via the through holes 58A, 60B.

Meanwhile, as shown in FIGS. 1, 2 and 4, an elastic member 64 serving as second sealing means is provided in the recessed portion 60A of the auxiliary side plate 60. The elastic member 64 has an oblong configuration conforming to the shape of the recessed portion 60A and through holes 64A into which The rotating shafts 54A, 56A of the rollers 54, 56 are respectively inserted are formed in the elastic member 64. Further, when the rollers 54, 56 are disposed between the pair of rack side plates 58, the thickness of the elastic member 64 is formed to be equal to or slightly larger than the distance between the bottom surface of the recessed portion 60A of the auxiliary side plate 60 and the end surfaces of the rollers 54, 56. When the rollers 54, 56 are disposed between the auxiliary side plates 60, the elastic member 64 elastically deforms and tightly abuts against the recessed portion 60A of the auxiliary side plate 60 and the end surfaces of the rollers 54, 56.

As a result, the clearance between the end surfaces of the rollers 54, 56 and the auxiliary side plate 60 are tightly scaled so as to prevent flowing of the processing solutions between the end surfaces of the rollers 54, 56 and the auxillary side plate 60. Meanwhile, as the elastic member 64, a non-water-absorptive sponge-like resin in which closed cells are formed, or a non-water-absorptive or non-hydrophilic member such as silicon rubber is used. Further, in is preferred that, in order to prevent flowing of the processing solutions, an area where the elastic member 64 contacts the rollers 54, 56 is large.

A pair of guide blocks 68, in which guide grooves 66 for guiding the film 14 between the rollers 54, 56 of the roller pair 52 are respectively formed, is provided at an upstream side of the roller pair 52 in the direction in which the film 14 is conveyed (i.e., the direction of arrow A). Further, a pair of guide blocks 70 each projecting from an interior of the insertion opening 36 of the partition plate 18 is provided at a downstream side of the roller pair 52 in the film-conveying direction. The pair of guide blocks 70 each include a guide groove 72 formed therein for guiding both transverse-direction ends of the film 14 nipped by the roller pair 52 and conveyed toward the insertion opening 36.

These guide grooves 66, 72 are each adapted to guide the film 14 in the predetermined direction by accommodating non-image portions at both transverse-direction ends of the film 14 in the same way as in the above-described guide groove 42. Respective upper and lower edges of the guide grooves 66, 72 facing the roller pair 52 are formed to project toward the roller pair 52 so that the film 14 can be reliably guided between the rollers of the roller pair 52 and the transverse-direction both ends of the film 14 conveyed from the roller pair 52 can be reliably accommodated in the guide grooves 72. Further, the respective surfaces of the guide blocks 68, 70 provided at respective upper and lower sides of the guide grooves 66, 72 and facing the rollers 54, 56 are curved along peripheral surfaces of the rollers 54, 56 and the guide blocks 68, 70 is thereby provided so as not to interfere with driving of the roller pair 52.

Meanwhile, as shown in FIGS. 1 and 4, substantially triangular blocks 74, 76 are provided in pairs between the pair of rack side plates 58 in such a manner as to be arranged vertically. These blocks 74, 76 are respectively provided to project from upper and lower portions of the insertion opening 86 of the partition plate 18 and both ends of each of the blocks 74, 76 in the transverse direction of the film 14 are tightly joined to inner surfaces of the auxiliary slate plates 60 respectively provided in the pair of rack side plates 58. For this reason, the upstream side of the insertion opening 36 in the film-conveying direction, and its vicinities are closely surrounded by the pair of rack side plates 58 and the blocks 74, 76. It should be noted that the blocks 74, 76 are formed to project toward the peripheral surfaces of the upper and lower rollers 54, 56 of the roller pair 52 and respective portions of the blocks 74, 76 facing the rollers 54, 56 are curved along the peripheral surfaces of the rollers 54, 56, respectively.

These blocks 74, 76 are provided with blades 78 which forms first sealing means together with the blocks 74, 76. The blades 78 are respectively formed to project from the upper surface of the block 74 and the lower surface of the block 78 toward the rollers 54, 56. End portions of the blades 78 abut against the peripheral surfaces of the rollers 54, 56, respectively. Meanwhile, the blades 78 are respectively brought into contact with the peripheral surfaces of the rollers 54, 56 between axial-direction both ends of the rollers 54, 56.

For this reason, there is no possibility of the processing solution flowing through clearances between the roller 54 and the block 74 and between the roller 56 and the block 76. Further, these blades 78 are each formed of a chemically resistant elastic body and are thereby brought into closely contact with the rollers 54, 56 without preventing rotation of the rollers 54, 56.

Meanwhile, the guide grooves 42, 66, 72 formed in the conveying racks 30, 32, 34 and the guide blocks 68, 70 are increased, at the upstream sides thereof in the conveying direction of the film 14, in respective dimensions in the transverse direction of the film 14 and in the direction of thickness of the film 14. As a result, there is no possibility that the conveying properties of the film 14 becomes inferior due to the film 14 being caught by connecting portions of the guide grooves 42, 66, 72.

Next, an operation of the present embodiment will be described.

In the automatic processing apparatus 10, the film 14 inserted into the apparatus by the insertion rollers 40 is conveyed into the washing water and/or stabilizing solution processing section 12. In the washing water and/or stabilizing solution processing section 12, after the film 14 inserted therein has been conveyed by the conveying rack 30 while being immersed in a color developing solution in the first washing (stabilizing) tank 24, the film 14 is guided to the partition rack 50 provided in the partition plate 18 between the first washing (stabilizing) tank 24 and the second washing (stabilizing) tank 26. The film 14 guided to the partition plate 5O is nipped by the roller pair 52 and is conveyed from the insertion opening 36 into the second washing (stabilizing) tank 26 adjacent to the first washing (stabilizing) tank 24 without being pulled out into the air.

After the film 14 has been immersed in washing water (stablizing solution) while being conveyed by the conveying rack 32 in the second washing (stabilizing) tank 26, the film 14 is guided to the partition rack 50 provided in the partition plate 18 between the second washing (stabilizing) tank 26 and the downstream-side third washing (stabilizing) tank 28. In the partition plate 50, the film 14 is conveyed from the insertion opening 36 into the washing tank 28 without being pulled out into the air.

After the film 14 conveyed into the third washing (stabilizing) tank 28 has been conveyed by the conveying rack 34 in the washing water, the film 14 is pulled out into the air and is conveyed from the washing water and/or stabilizing solution processing section 12 to an unillustrated drying section.

In the automatic processing apparatus 10, the film 14 is conveyed in the processing solutions in the tanks of the processing section 12 without being pulled out into the air. After the film 14 has been processed with each of the processing solutions for washing and/or stabilization, it is dried and is finished as a developed film. For this reason, for example, when the film 14 is conveyed to a processing tank at a downstream side in the film conveying direction, there is no possibility that the film 14 is substantially brought into a non-processed state due to the film 14 being pulled out into the air. Accordingly, the film 14 can be efficiently processed in a short time.

Further, in the automatic processing apparatus 10, the washing and/or stabilizing processing tank unit 16 is divided into the first washing (stabilizing) tank 24, the second washing (stabilizing) tank 26, and the third washing (stabilizing) tank 28, and the partition rack 50 provided to face the insertion opening 36 is formed in the partition plate 18 in which the insertion opening 38 for directly inserting the film 14 from an upstream-side processing tank to a downstream-side processing tank is formed. The partition rack 50 is provided to closely surround the insertion opening 36 by the pair of rack side plates 58, the auxiliary side plates 60, and the blocks 74, 76.

The roller pair 52 is disposed in an open space surrounded by the rack side plates 58 and the blocks 74, 78 surrounding the insertion opening 36. The blades 78 projecting from the blocks 74, 76 respectively abut against the peripheral surfaces of the upper and lower rollers 54, 56 of the roller pair 52. Since the blades 78 closely abut against the peripheral surfaces of the rollers 54, 56 along respective axial lines of the rollers 54, 58, there is no possibility of the processing solution flowing through the clearances between the peripheral surfaces of the roller pair 52 and the blocks 74, 76. Meanwhile, it is preferred that the blades 78 are formed in such a manner that each fractional wear blades 78 and the rollers 54, 56 is small when the blades 78 contacts the rollers 54, 56, and that the shape and material of the blades 78 are provided to closely contact the peripheral surfaces of the rollers 54, 56.

Further, the elastic body 64 is provided between each of the auxiliary side plates 60 of the rack side plates 58 between which the roller pair 52 is interposed, and each of the end surfaces of the rollers 54, 56. The elastic member 64 is used to seal the clearance between the end surfaces of the rollers 54, 56 and the auxiliary side plate 60 without preventing rotation of the rollers 54, 56. As a result, there is no possibility of the processing solution flowing through the clearance.

Namely, The clearance formed in the vicinity of the roller pair 52 which is disposed in the open space between the rack side plates 58 and the blocks the vicinity of the insertion opening 38 is tightly sealed by the blades 78 and the elastic members 64. As a result, the upstream side and downstream side of the roller pair 52 can be tightly sealed and it is possible to reliably prevent the processing solutions in the upstream-side tank and the downstream-side tank from mixing with each other via the insertion opening 36.

When the processing solutions in the upstream-side tank and the downstrearm-side tank are mixed with each other, the processing properties of the processing solutions deteriorate and the finished condition of the film 14 becomes inferior. In order to solve these drawbacks, it is necessary to increase an amount of a replenisher of each of the processing solutions and to effect replacement of each processing solution (i.e., replacement of each mother liquid) frequently. In this case, the running cost of the apparatus increases.

On the other hand, in the present embodiment, the partition rack 50 is disposed opposite to the insertion opening 36 which is formed between the adjacent processing tanks. For this reason, it is possible to reliably prevent the processing solutions in the adjacent processing tanks from flowing through the insertion opening 36 and mixing with each other. Accordingly, it is not necessary to increase an amount of a replenisher under the prospect in that the processing solutions are mixed with each other, and to frequently effect replacement of the processing solutions.

As a result, in the automatic processing apparatus 10, the efficient processing off the film 14 can be effected and it is not necessary to increase each amount of the processing solution and the replenishers thereof, which result in no increase in the running cost. Further, since replenishment of the replenishers and replacement of the processing solutions can be reduced, the maintenance of the apparatus becomes easy.

Meanwhile, the present embodiment shows an example of the present invention, and the present invention is not limited to the same. For example, the clearance between the rack side plates 58 and the rollers 54, 56 may be sealed with the rack side plates 58 and the end surfaces of the rollers 54, 56 being disposed opposite to each other without using the auxiliary side plates 60.

Further, in order to prevent flowing of the processing solutions by sealing the peripheries of the rollers, it suffices that not only the clearance formed on the peripheral surfaces of the rollers, but also the clearances which tend to be formed on the end surfaces of the axial-direction both ends of the rollers are sealed.

Figure 5:
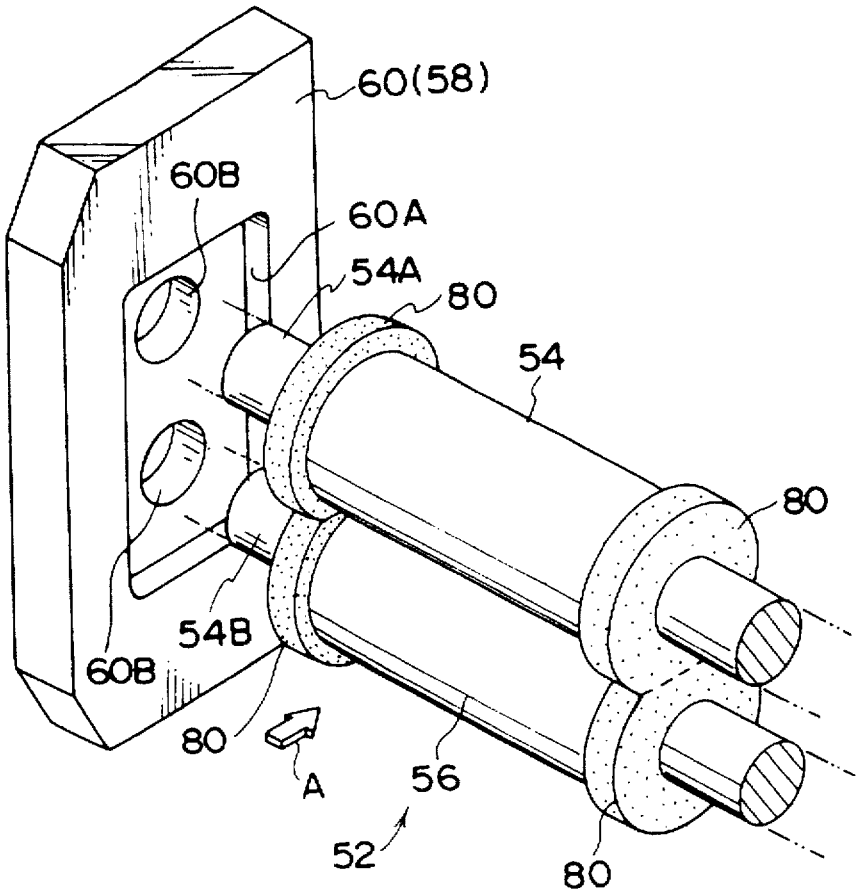
FIG. 5 is a perspective view of a main portion in the vicinity of a roller pair to which a second sealing means is applied.

For example, as shown in FIG. 5, circular plate-shaped elastic members 80 which are each larger than an outside dimension off each off the rollers 54, 56 of the roller pair 52 are mounted to respective end surfaces off the rollers 54, 56 may be mounted concentrically to the end surfaces of the rollers 54, 56 of the roller pair 52, and the roller pair 52 may be inserted in the recessed portions 60A of the auxiliary side plates 60. At this time, the clearances between the inner wall surfaces of the recessed portions 60A and the end surfaces of the rollers 54, 56 are tightly sealed so as to prevent the processing solution from flowing between each of the recessed portions 60A and the end surfaces of the rollers 54, 56.

As the elastic member 80, various elastic bodies such as non-water-absorptive sponge-like resin, rubber, and the like can be used.

As the method for sealing the clearance between the end surfaces of the rollers and each of the side plates, there is disclosed a method in which the outside dimension of each of the rollers is made a little larger than the size of each hole formed in the side place and the end surface of the roller in the vicinities of the outer peripheral portion thereof is brought into contact with the peripheral edge portion of the hole of the side plate so as to seal the clearance between the end surfaces of the rollers and each of the side plates (for example, see U.S. patent application No. Ser. 5,313,242). In the sealing method as aforementioned, it is necessary that the outer peripheral portion of each roller has a double structure and a special roller is used which has a lubricative material in the outer peripheral portion of the roller. Further, a high-priced roller with high accuracy is required by the reason that the outside dimension of the roller affects the sealing properties thereof. In addition, when the clearance is formed between the upper and lower rollers, the sealing properties of the rollers deteriorate due to the clearance. For this reason, when a thick material is inserted between the rollers of the roller pair, the sealing properties deteriorate or conveying of the chick material becomes difficult.

On the contrary, the elastic members 80 are disposed between the auxiliary side plates 60 and the end surfaces of the rollers 54, 56, respectively, so as to seal the clearances formed therebetween. The elastic members 80 provided at each of axial-direction ends of the roller pair 52 are made larger than the outside dimension of the rollers 54, 56, and at a point where the rollers 54, 58 contact each other, the elastic members 80 are pressed against each other and an area where the elastic members 80 contact each other are made larger. For this reason, when the film 14 is inserted between the rollers 54, 56, the sealing properties at the sides of the end surfaces of the rollers 54, 56 does not deteriorate even if the clearance between the rollers 54, 56 is formed. Namely, in the present embodiment, the film 14 can reliably be nipped and conveyed by the rollers 54, 56.

Further, in the above-described sealing method, it necessary that the holes to be provided in the side plate accurately formed substantially into the figure of "8" to conform to the outer peripheral surface of the roller. However, in the present embodiment, it is not necessary that the recessed portion 60A formed in the auxiliary side plate 60 is accurately formed to conform to the peripheral surfaces of the rollers 54, 56. For example, it suffices that the recessed portion 60A formed into a substantially rectangle is partitioned by the elastic member 80 from an upper end to a lower end of the recessed portion 60A.

Since the elastic member 80 is not water-absorptive, it does not absorb the processing solution even when pressed to contract. Accordingly, there is no possibility that a crashed portion of the elastic members 80 provided in pairs by the elastic members 80 being pressed against each other absorbs the processing solution even when force of pressure is released and the crashed portion expands. As a result, even when the elastic members 80 expands and contracts repeatedly, mixing of the processing solutions in the upstream-side tank and the downstream-side tank is not caused. Meanwhile, the elastic members 80 are preferably made softer than the rollers 54, 56 (i.e., the hardness of the elastic members 80 is made smaller than that of the rollers 54, 56).

Figure 6:
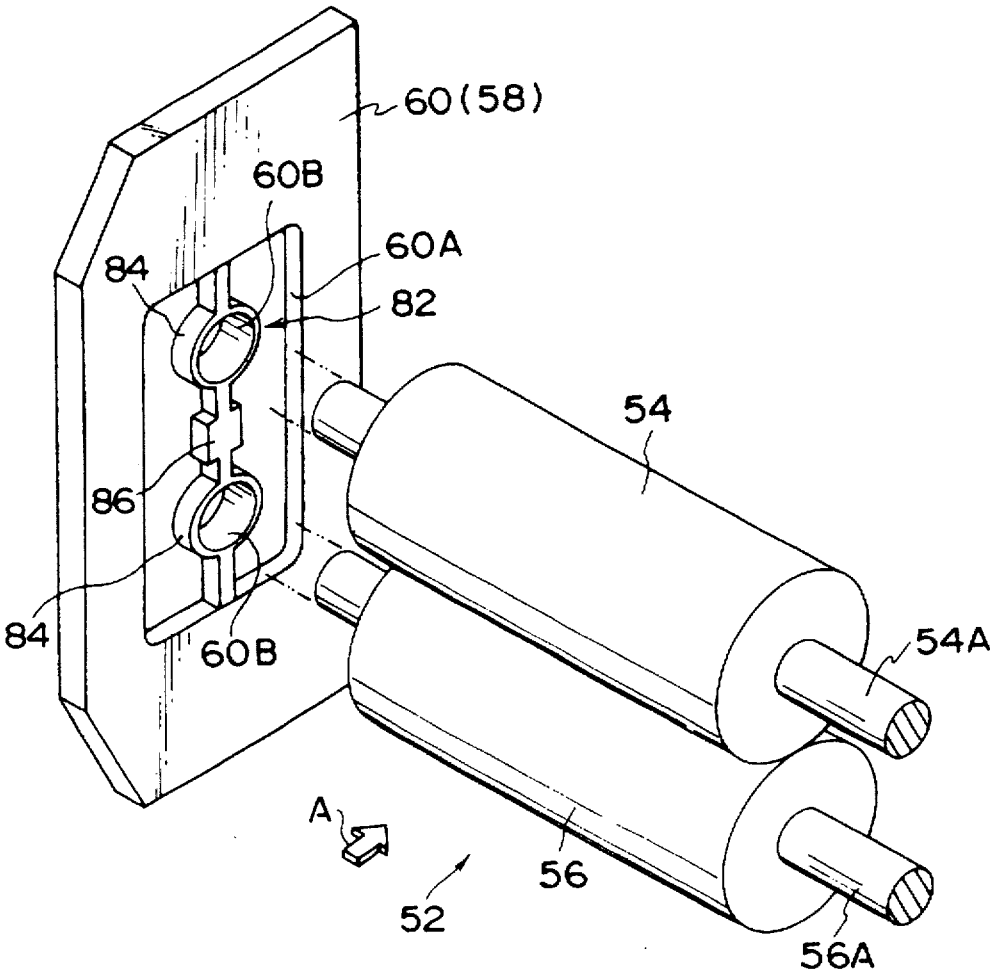
FIG. 6 is a perspective view of a main portion in the vicinity of a roller pair to which the second sealing means is applied.

Further, as shown in FIG. 6, a rib 82 may be formed the recessed portion 60A of the auxiliary side plate 60. The rib 82 includes diameter enlarging portions 84 through which the rotating shafts 54A, 56A passes, and a width enlarging portion 86 which faces a point of contract between the rollers 54, 56 and its vicinities in a wide range. Further, in the upper end portion and the lower end portion of the rib 82, the blades 78 (not shown in FIG. 6) contact the peripheral surfaces of the rollers 54, 56, respectively.

By using the rib 82 formed in this way, the clearances between the end surfaces of the rollers 54, 56 and the auxiliary side plates 60 can be sealed.

The rib 82 can be formed of non-water-absorptive sponge, rubber, or the like, in the same way as in the elastic members 78, 80.

Further, a member having a low coefficient of friction, for example, Teflon, high-polymer polyethylene, and the like may be used as the rib 82. At this time, it suffices that a member having a low coefficient of friction (i.e., the member having the same material as the rib 82) is used for the end surfaces of the rollers 54, 56 so that a frictional resistance when the rib 82 contacts the rollers 54, 56 becomes lower. Further, a lubricating member such as silicone grease or the like may also be interposed between the end of the rib 82 and the end surfaces of the rollers 54, 56 when necessary.

As a result, the clearances between the auxiliary side plates 60 and the rollers 54, 56 can be sealed. Particularly, by providing the lubricating member such as silicone grease as a sliding member, the clearance between the contact surface at the end of the rib 82 and the end surfaces of the rollers 54, 56 can be tightly sealed. Meanwhile, when the end surfaces of the rollers 54, 56 are brought into directly contact with the auxiliary side plates 60 (or the rack side plates 58), the end surfaces of the rollers 54, 56 may be brought into directly contact with the surfaces of the auxiliary side plates 60 or the rack side plates 58 without using the rib 82 or the like.

Figure 7:
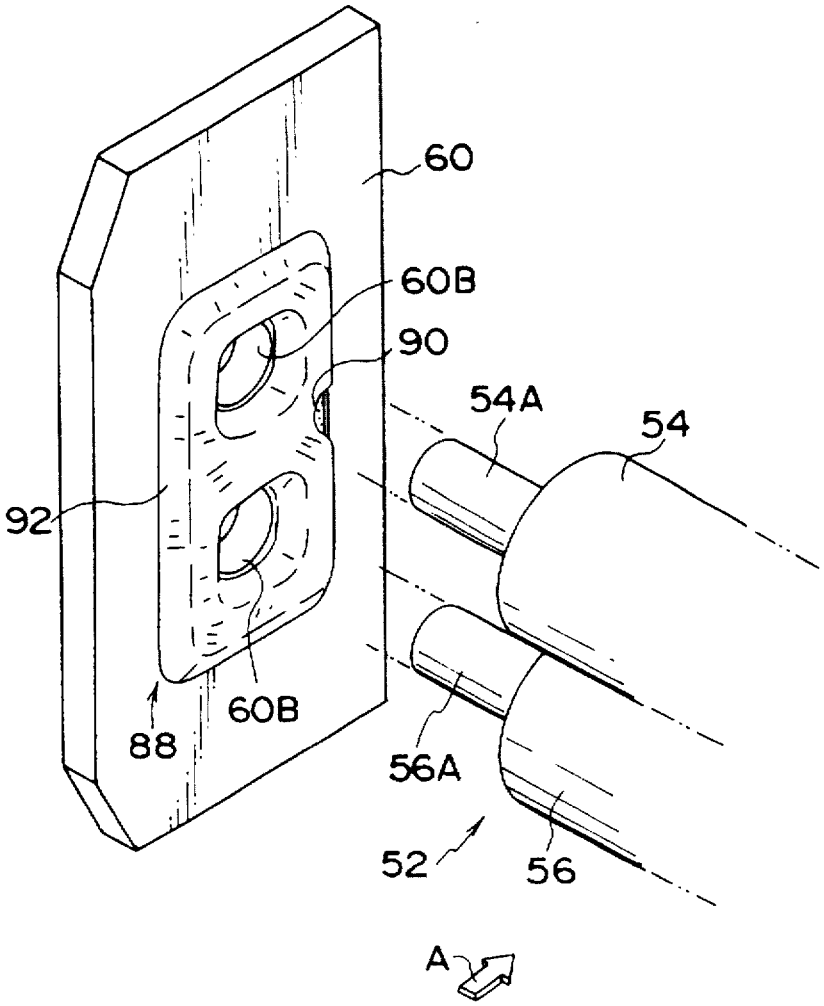
FIG. 7 is a perspective view of a main portion in the vicinity of a roller pair to which the second sealing means is applied.

Further, as shown in FIG. 7, a sealing member 88 may be provided at the periphery of the through holes of the auxiliary side plate 60. A gel member 90 is used as the sealing member 88. The gel member 90 can be used in such a manner as to be accommodated in a bag-shaped sliding member 92 when necessary.

The sealing member 88 disposed between the auxiliary side plate 60 and the end surfaces of the rollers 54, 56 is pressed therebetween to tightly seal the clearance between the auxiliary side plate 60 and the rollers 54, 56 due to its flowability. At this time, since the sliding member 92 is used, there is no possibility that rotation of the rollers 54, 56 is prevented. Meanwhile, even when the sealing member 88 is used, the sealing member 88 can face the point where the rollers 54, 56 contact each other in a wide range so as to reliably seal the clearance.

Figure 8:
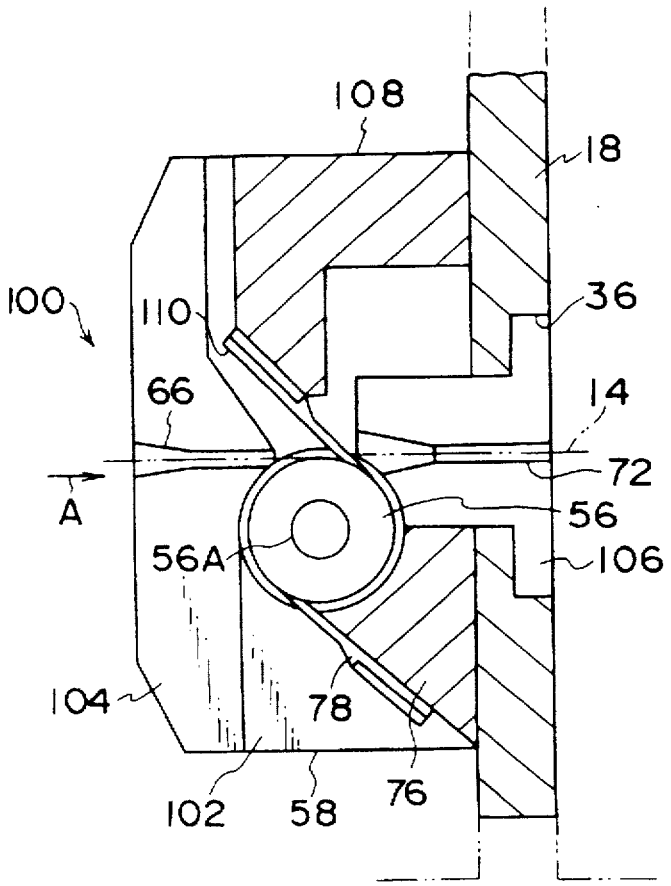
FIG. 8 is a schematic cross-sectional view showing an example of a partition rack to which the present invention can be applied.

Further, the present embodiment is constructed in that the film 14 is nipped and conveyed by the pair of rollers 54, 56 provided in the partition rack, but the present invention is not limited to the same. As shown in FIG. 8, a partition rack 100 may be used in which conveying force is applied to the film 14 by one roller 56.

In the partition rack 100, guide blocks 104 are provided each in which a guide groove 66 is formed in an auxiliary side plate 102 provided in a rack side plate 58 projecting from the partition plate 18, and a guide block 106 including a guide groove 72 is formed to project from the insertion opening 36. Further, a substantially L-shaped block 108 is disposed above the roller 56 in such a manner as to project from the partition plate 18 and the roller 56 is interposed between the block 108 and the auxiliary side plate 102.

A blade 110 is provided at an end portion of the block 108 which is disposed further toward the upstream side than the roller 56. The blade 110 closely abuts against an upper peripheral surface of the roller 56 to tightly seal the clearance between the upper peripheral surface of the roller 56 and the block 108.

In the partition rack 100 constructed in the above-described manner, the film 14 guided by the guide groove 66 and inserted into the partition rack 100 is conveyed from a position between the roller 56 and the blade 110 into the guide groove 72. Even when the blade 110 is provided only in one side, the film 14 can reliably be conveyed.

Even when the partition rack 100 is used, the present invention is applied to a portion between the end surface of the roller 56 and the auxiliary side plate 102 so as to tightly seal the clearance therebetween. As a result, it is possible to reliably prevent the processing solutions in the upstream-side tank and the downstream-side tank from mixing each other.

In addition, the present invention can be applied to a structure in which a conventional method for removing a clearance formed on a peripheral surface of a roller applying conveying force to a photosensitive material is used. Accordingly, in the photosensitive material processing apparatus in which a photosensitive material is directly conveyed from an upstream-side processing solution to a downstream-side processing solution without passing through the air, the processing solution does not only flow on the peripheral surface of the roller, but also does not flow in the vicinities off the axial-direction end surfaces of the roller, thereby making it possible to reliably prevent the upstream-side processing solution and the downstream-side processing solution from mixing each other.

Meanwhile, the first embodiment was described by using the automatic processing apparatus 10 for guiding and conveying the film 14 by the guide groove 42. However, the structure of the photosensitive material processing apparatus to which the present invention is applied is not limited to the same. For example, the photosensitive material is not limited to the elongated negative film and a sheer-shaped film may also be used. Further, the photosensitive material processing apparatus may be used which processes other photosensitive material such as a photographic printing paper or the like.

(Second Embodiment)

The photosensitive material used in the present embodiment was prepared by the following manner.

(1) Supports 100 weight pares of polyethylene-2,6-naphthalate polymer and 2 weight parts of Tinuvin P.326 (manufactured by Geigy) as an ultra-violet ray absorbing agent were dried and molten at 300° C. The molten mixture was extruded from a T-type and drawn to 3.3 times at 140° C. In the longitudinal direction, and thereafter drawn to 3.3 times at 130° C. In the transverse direction, and further thermally fixed for six seconds at 250° C., so that a PEN film having a thickness of 90 μm was obtained. Applied to the PEN Film was blue dyes, magenta dyes, and yellow dyes (the above Kokal Giho (Laid-Open Technical Report) No. 94-6023, I-1, I-4, I-6, I-24, I-26, I-27, II-5). Further, the PEN film was wound around a stainless steel core having a diameter of 20 cm and subjected to heat history for 48 hours at 110° C., so support whose trained curl behavior is prevented was obtained.

(2) Coating of subbing layer

Both sides of the support above were processed by a corona discharge method, a UV discharge method, and a glow discharge method and the subbing layer was coated on the side which was exposed to a higher temperature during the extrusion, with a coating solution composed of 0.1 g/m$^2$ of gelatin, 0.01 g/m$^2$ of sodium α-sulfo-di-2-ethylhexylsuccinate, 0.04 g/m$^2$ of salicylic acid, 0.2 g/-V of P-chlorophenol, 0.012 g/m$^2$ of $(CH_2{=}CHSO_2CH_2CH_2NHCO)_2CH_2$, and 0.02 g/m$^2$ of polyamide-epichlorohydrine polycondensate (10 cc/m$^2$, a bar coater is used). The support with the subbing layer coated was dried for six minutes at 115° C. (each temperature of rollers in a drying section, and a conveying apparatus is 115° C. ).

(3) Coating of back layers

The back layers, namely, an antistatic layer, a magnetic recording layer and a sliding layer, each having the following compositions, were coated on one side of each of the supports with the undercoated layer coated.

(3-1) Coating of antistatic layer 0.2 g/m$^2$ of dispersed fine power in which a resistivity of tin oxide-antimony oxide complex having an average particle diameter of 0.005 μm is 5 Ω–cm (secondary agglomerate particle diameter: about 0.08 μm) was coated together with 0.05 g/m$^2$ of gelatin, 0.02 g/m$^2$ of $(CH_2{=}CHSO_2CH_2CH_2NHCO)_2CH_2$, 0.005 g/m$^2$ of poly(degree of polymerization: 10)oxyethylene-p-nonylphenol, and resorcin. (3-2) Coating of magnetic recording layer 0.06 g/m$^2$ of cobalt-γ-ferric oxide (specific surface area: 43 m$^2$/g, major axis: 0.14 μm, minor axis: 0.03 μm, saturation magnetization: 89 emu/g, $Fe^{+2}/Fe^{+3}$=6/94, the surface was processed with aluminium oxide and silicon oxide (2 percentage by weight of the ferric oxide) coated by 3-poly (degree of polymerization: 15)oxyethylene-propyloxytrimethoxysilane (15 percentage by weight) was coated by a bar coater with 1.2 g/m$^2$ of diacetylcellulose (dispersion of the ferric oxide was carried out by an open kneader and a sand mill), 0.3 g/m$^2$ of $C_2H_5C(CH_2OCONH{-}C_6H_3(CH_3)NCO)_3$ as a hardening agent, and acetone, methyl ethyl ketone, cyclohexanone as solvents, so that a magnetic recording layer having a film thickness of 1.2 μ was obtained. Silica particles (0.3 μm) and aluminium oxide (0.15 μm) of abrasives coated with 3-poly (degree of polymerization: 15)oxyethylenepropyloxytrimethoxysilane (15 percentage by weight) were applied as a matting agent to have 10 mg/m$^2$, respectively. The resultant magnetic recording layer was dried for six minutes at 115° C. (each temperature of the rollers in the drying section and the conveying apparatus is 115° C.). The increment in color density of DB of the magnetic recording layer in X-Rite (blue filter) was about 0.1, the saturation magnetization moment of the magnetic recording layer was 4.2 emu/g, the coercive force was 9230e, and the rectangularity ratio was 65%.

(3-3) Preparation of sliding layer

Diacetylcellulose (25 mg/m$^2$) and mixtures of $C_6H_{13}CH(OH)C_{10}H_{20}COOC_{40}H_{81}$(compound a, 6 mg/m$^2$)/$C_{50}H_{101}O(CH_2CH_2O)_{16}H$(compound b, 9 mg/m$^2$) were coated. The mixtures of compound a/compound b were molten in xylene/propylenemonomethylether (1/1) at 105° C. and were added to and dispersed in propylenemonomethylether (amount of ten times) of ordinary temperature. Thereafter, the obtained mixture was dispersed in acetone (average particle diameter: 0.01 μ) and was applied. Silica particles (0.3 μm) and aluminium oxide (0.15 μm) of abrasives coated with 3-poly(degree off polymerization: 15)oxyethylenepropyloxytrimethoxysilane (15 percentage by weight) were applied as a matting agent to have 15 mg/m$^2$, respectively. The resultant product was dried for six minutes at 115° C. (each temperature of the rollers in the drying section and the conveying apparatus is 115° C.). The sliding layer has excellent characteristics, i.e., the coefficient of dynamic friction thereof is 0.06 (a stainless-steel ball of 5 mm ϕ, load: 100 g, speed: 6 cm/min.), the coefficient of static friction thereof is 0.07 (clip method), and the coefficient of dynamic friction between an emulsion layer described later and the sliding layer is 0.12.

(4) Coating of photosensitive layer

Next, layers each having the following composition were coated in a multilayered manner on the side opposite to the above back layers and a color negative photographic film was obtained.

Preparation of photosensitive layer

Layers each having the following composition were coated in a multilayered manner and samples as the color negative films was prepared.

(Preparation of emulsion)

Preparation off silver iodobromide emulsion:

30 g of inert gelatin and 6 g of potassium bromide were dissolved in one litter of distilled water to form an aqueous solution, and the mixture was stirred at 75° C., to which 35 cc of an aqueous solution containing 5.0 g of silver nitrate and 35 cc of an aqueous solution containing 3.2 g of potassium bromide and 0.98 g of potassium iodide were added over a 30-second period at a flow rate of 70 co/min. Subsequently, pAg was raised to 10 and the resultant mixture was ripened for 30 minutes. Thus, an original emulsion was prepared.

A predetermined portion in one liter of an aqueous solution in which 145 g of silver nitrate was dissolved, and an aqueous solution of the mixture of potassium bromide and potassium iodide were added to the original emulsion so as to be molar equivalent with each other at a predetermined temperature, at a predetermined pAg, and at a speed near a critical growth rate, and a tabular core emulsion was thus prepared. Subsequently, the remaining portion of the aqueous solution of silver nitrate and an aqueous solution of the mixture of potassium bromide and potassium iodide having a different composition from that of the case of preparation of the above core emulsion were added to the core emulsion so as to be molar equivalent with each other at the speed near a critical growth rate, by which the core was coated. Thus, a core/shell-type silver iodobromide emulsion was prepared.

Adjustment of an aspect ratio was carried out by appropriately selecting the pAg at the time of preparation of core and shell.

The aspect ratio of each grains in 1.000 emulsion grain was measured and the projected area ratio of the grains having the aspect ratio of 2:1 or more was 64%. The projected area ratio of the grains having the aspect ratio of 5:1 or more was 48%. The average grain diameter was 1.63 μm, the average grain thickness was 0.36 μm, and the average iodine content was 7.6 mole %. Further, it was confirmed by a transmission electron microscope that ten or more dislocation lines exist in 80% or more of these emulsion grains.

Next, the above emulsion was subjected to gold-sulfur sensitization.

The temperature of the emulsion was increased to 60° C., and sensitizing dye ExS-6 was added thereto in an amount indicated by the fourteenth layer of the photosensitive layer compositions. The resultant emulsion was held for 20 minutes at 60° C., to which, thereafter, $1.0\times10^{-5}$ mole of 1-(4-carboxylphenyl)-5-mercaptotetrazole/mole Ag, $0.19\times10^{-5}$ mole/mole Ag of sodium thiosulfate, $0.88\times10^{-5}$ mole of chloroauric acid/mole Ag, and $180\times10^{-5}$ mole of pottasium thiocyanate/mole Ag were added at 60° C. and at the pH of 6.3 and was subjected to gold-sulfur sensitization. The gold-sulfur sensitization was carried out so that each of the emulsions becomes most suitable. The expression "the gold-sulfur sensitization was carried out so that each of the emulsions becomes most suitable" means chemical sensitization, in which after the gold-sulfur sensitization, the sensitivity at the time off exposure for 1/100 second becomes highest.

(Preparation of multilayered color photosensitive material)

A sample which is a multilayer color photosensitive material formed of each layer of the following composition was prepared on a poly(ethylene-naphthalene-2,6-dicarboxylic acid) film support whose thickness is 90 μm having a magnetic recording layer with a subbing layer coated thereon.

(Composition of photosensitive layer)

Each coating amount of silver halide and colloidal silver is represented by the unit of g/m$^2$ of silver halide and colloidal silver, each coating amount of a coupler, additives, and gelatin is represented by the unit of g/m$^2$, and the coating amount of each sensitizing dye is represented by the number of moles per one mole of silver halide in the same layer. Meanwhile, the symbols described below indicates respective additives, and when a plurality of effects are provided, one of them is representatively shown.

UV: ultraviolet absorbing agent, Solv: high-boiling point organic agent, ExF: dyes, ExS: sensitizing dye, ExC: cyan coupler, ExM: magenta coupler, ExY: yellow coupler Cpd: additives.

The first layer (antihalation layer):

| | |
|---|---|
| Black colloidal silver | 0.15 |
| Gelatin | 1.00 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |

UV-1

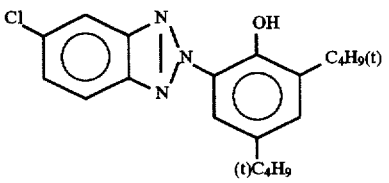

UV-2

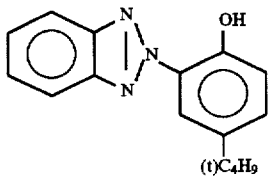

UV-3

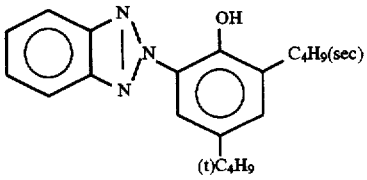

ExF-1

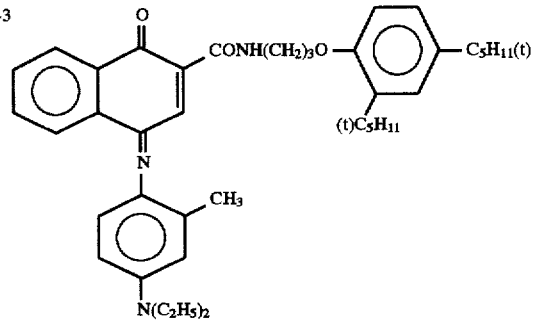

ExF-2

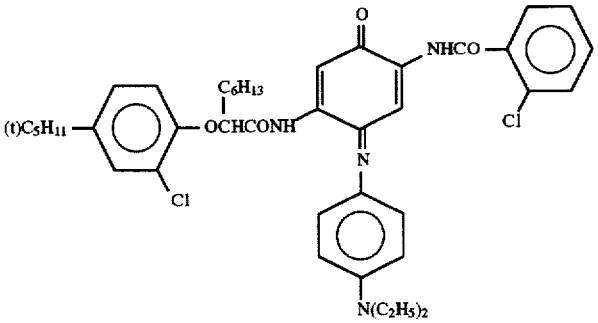

-continued

ExF-3

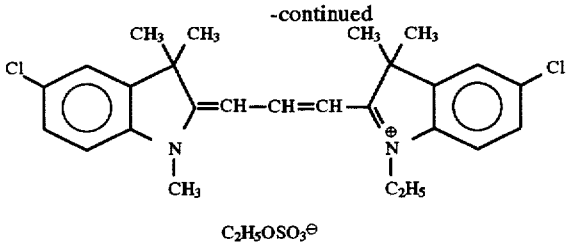

ExM-3

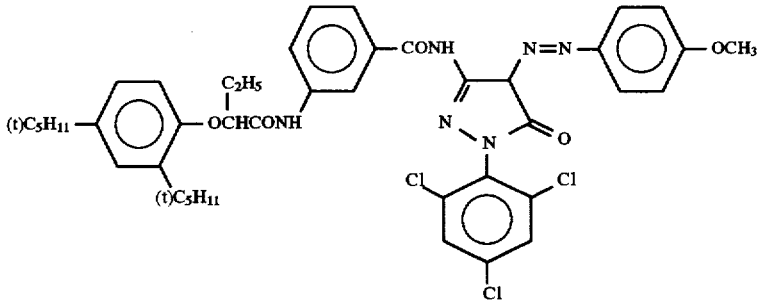

Cpd-5

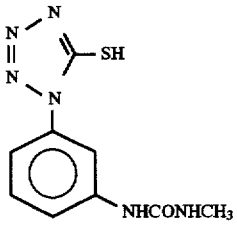

Solv-1

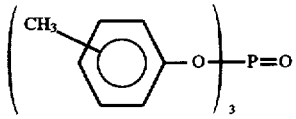

Solv-2

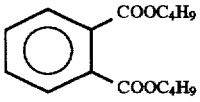

The second layer (low-speed red sensitive emulsion layer)

| | |
|---|---|
| Silver iodobromide emulsion A (amount of silver coated) | 0.35 |
| Silver iodobromide emulsion B (amount of silver coated) | 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $5.0 \times 10^{-3}$ |

-continued

| | |
|---|---|
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-4 | $2.2 \times 10^{-2}$ |
| Cpd-7 | $1.3 \times 10^{-3}$ |

ExS-1

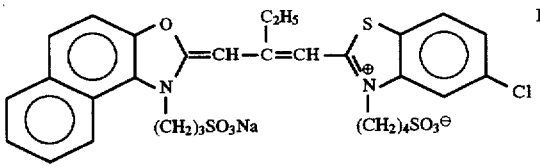

ExS-2

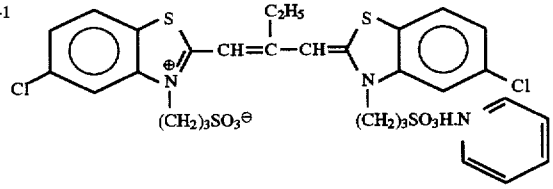

-continued
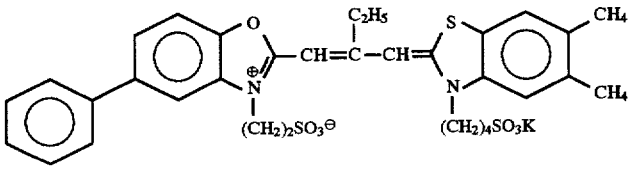
ExS-5
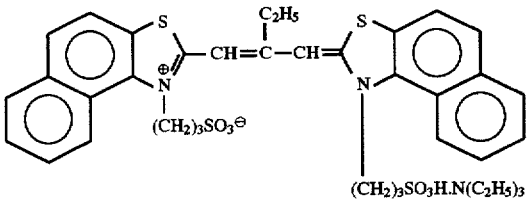
ExS-7
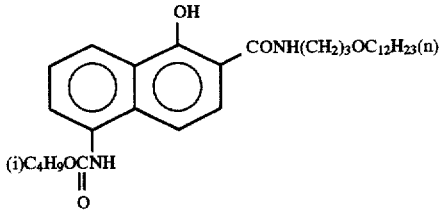
ExC-1
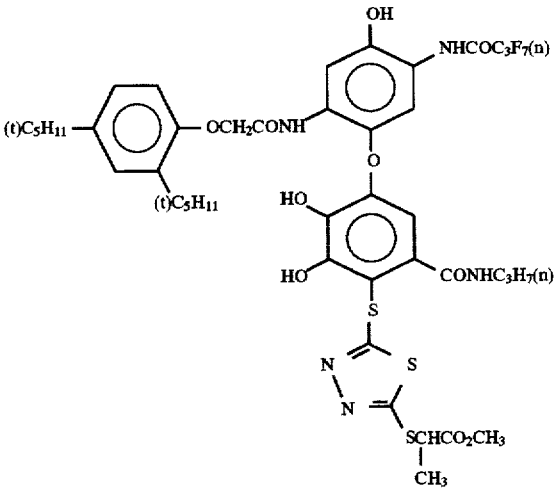
ExC-2
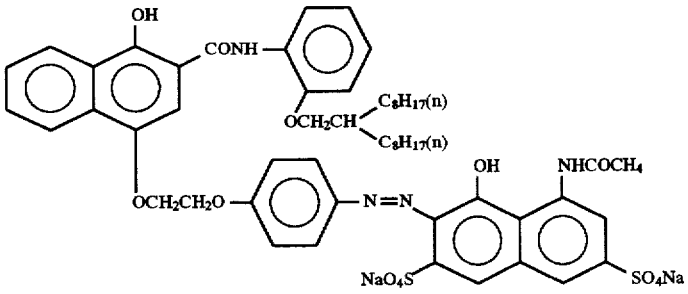
ExC-3
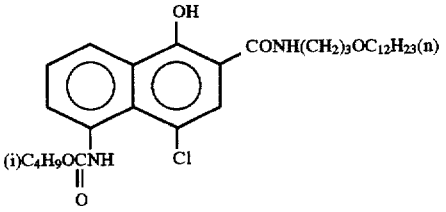
ExC-5

-continued
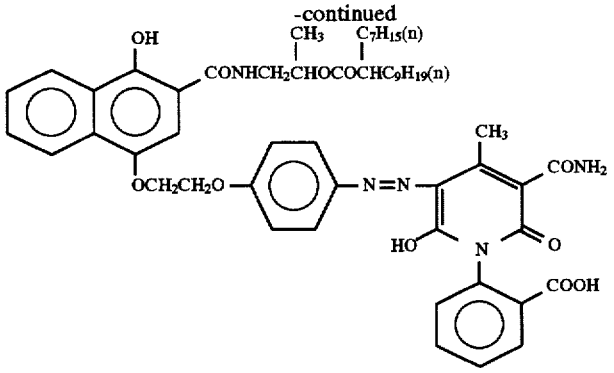
ExC-6
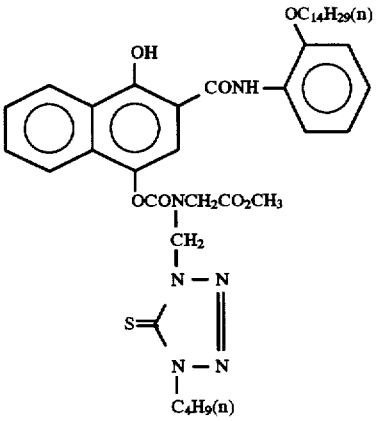
ExC-9
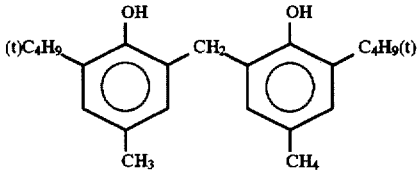
Cpd-4
$(CH_3(CH_2)_3CH(C_2H_5)CH_2)_2SO$
Cpd-7
The third layer (medium-speed red sensitive emulsion layer)
| | |
|---|---|
| Silver iodobromide emulsion C (amount of silver coated) | 0.55 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
-continued
| | |
|---|---|
| ExC-9 | $3.0 \times 10^{-2}$ |
| Cpd-4 | $1.5 \times 10^{-3}$ |
| Cpd-7 | $2.5 \times 10^{-3}$ |
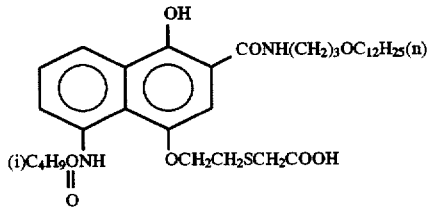
ExC-4

-continued

ExC-7

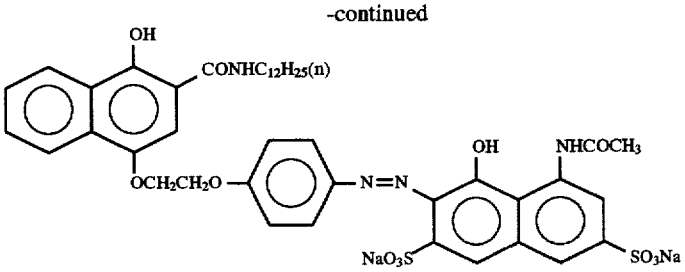

The fourth layer (high-speed red sensitive emulsion layer)

| | |
|---|---|
| Silver iodobromide emulsion D (amount of silver coated) | 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Cpd-7 | $1.0 \times 10^{-3}$ |
| Solv-1 | 0.70 |
| Solv-2 | 0.15 |

ExC-8

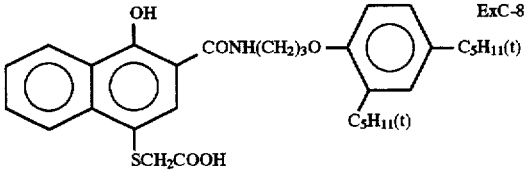

The fifth layer (intermediate layer)

| | |
|---|---|
| Geletin | 0.62 |
| Cpd-1 | 0.13 |
| Polyethyl acrylate latex | $8.0 \times 10^{-2}$ |
| Solv-1 | $8.0 \times 10^{-2}$ |

Cpd-1

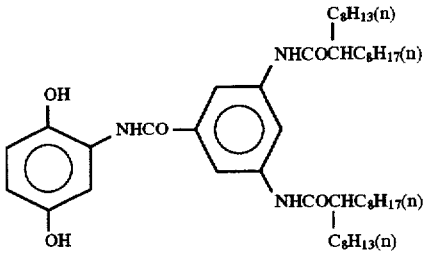

The sixth layer (low-speed green sensitive emulsion layer)

| | |
|---|---|
| Silver iodobromide emulsion E (amount of silver coated) | 0.10 |
| Silver iodobromide emulsion F (amount of silver coated) | 0.28 |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-7 | $2.1 \times 10^{-2}$ |
| Solv-1 | 0.09 |
| Solv-3 | $7.0 \times 10^{-3}$ |
| Solv-5 | 0.05 |
| Solv-6 | 0.06 |

ExS-3

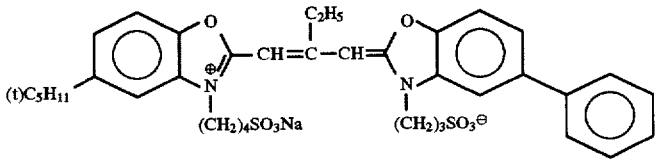

ExS-4

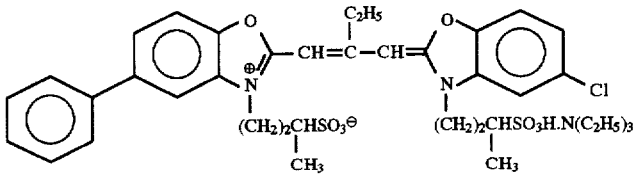

-continued
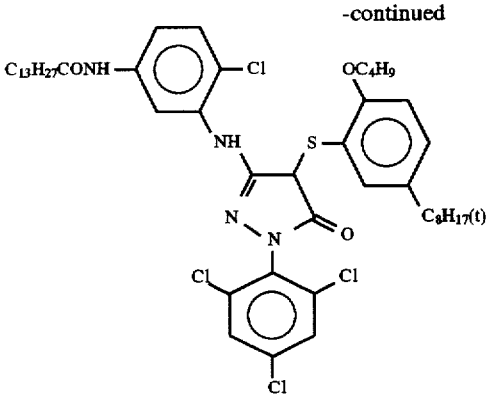
ExM-1
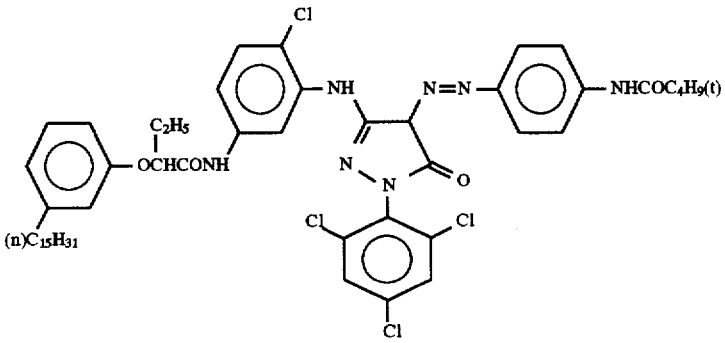
ExM-7
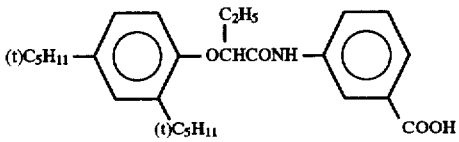
Solv-3
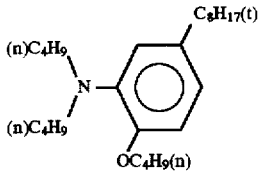
Solv-5
$C_{11}H_{23}CON(C_4H_9)_2$
Solv-6
The seventh layer (medium-speed green sensitive emulsion layer)
| | |
|---|---|
| Silver iodobromide emulsion G (amount of silver coated) | 0.20 |
| Silver iodobromide emulsion H (amount of silver coated) | 0.20 |
| Gelatin | 0.54 |
| ExS-3 | $2.7 \times 10^{-4}$ |
| ExS-4 | $8.2 \times 10^{-4}$ |
-continued
| | |
|---|---|
| ExS-5 | $1.7 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| Solv-5 | 0.10 |
| Solv-6 | 0.20 |

ExY-1
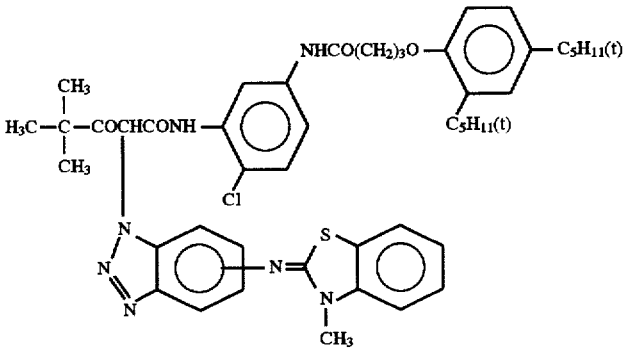
The eighth layer (high-speed green sensitive emulsion layer)
| | |
|---|---|
| Emulsion P (amount of silver coated) | 0.65 |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $5.5 \times 10^{-3}$ |
| ExM-3 | $1.0 \times 10^{-2}$ |
-continued
| | |
|---|---|
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| Solv-5 | 0.05 |
ExS-8
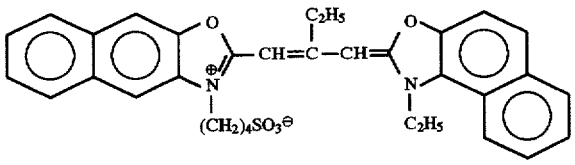
ExM-2
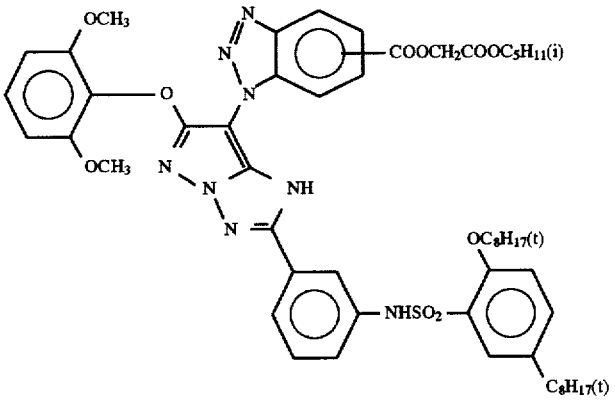
ExM-6
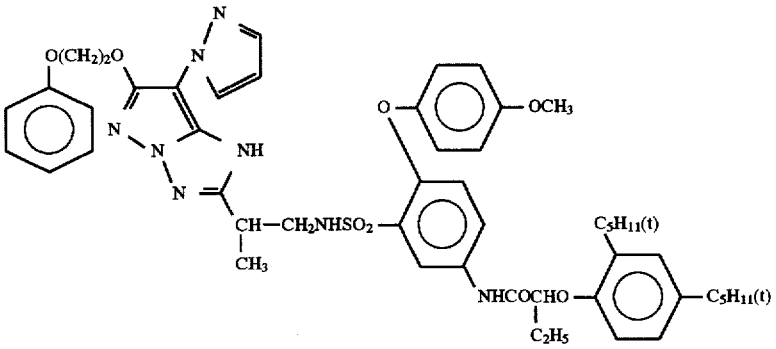

-continued

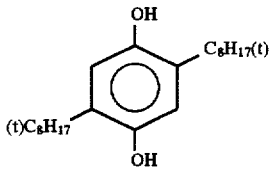

Cpd-6

The ninth layer (intermediate layer)

| | |
|---|---|
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethyl acrylate latex | $5.0 \times 10^{-2}$ |
| Solv-1 | $3.0 \times 10^{-2}$ |

UV-4

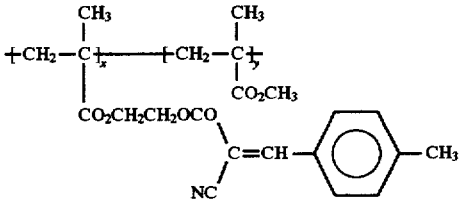

x:y = 70:30 (wt %)

UV-5

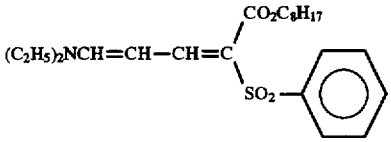

The tenth layer (interimage effect donor layer for red sensitive layer)

| | |
|---|---|
| Silver iodobromide emulsion I (amount of silver coated) | 0.40 |
| Silver iodobromide emulsion J (amount of silver coated) | 0.20 |
| Silver iodobromide emulsion K (amount of silver coated) | 0.39 |
| Gelatin | 0.87 |
| ExS-3 | $6.7 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |

ExM-4

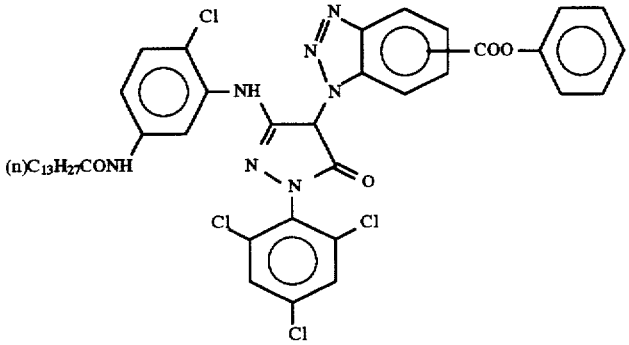

ExM-5

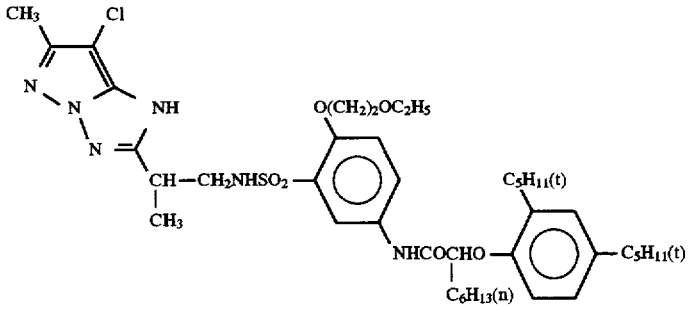

-continued

ExY-2

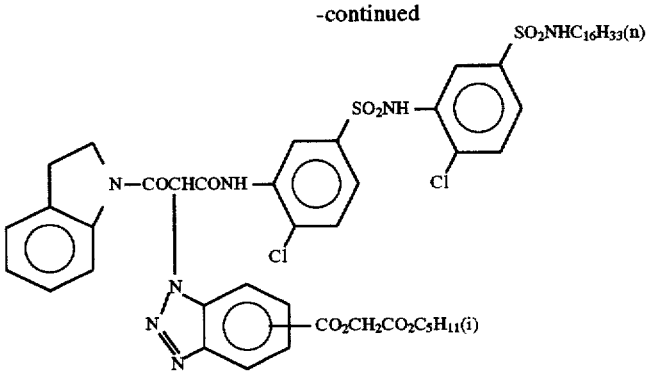

ExY-5

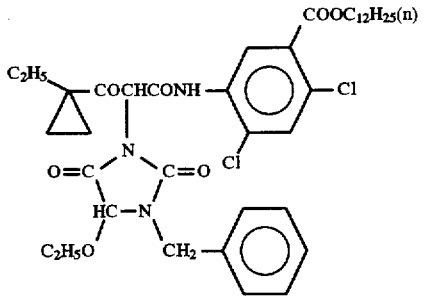

The eleventh layer (yellow filter layer)

| | |
|---|---|
| Yellow colloidal silver | $9.0 \times 10^{-2}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |

Cpd-2

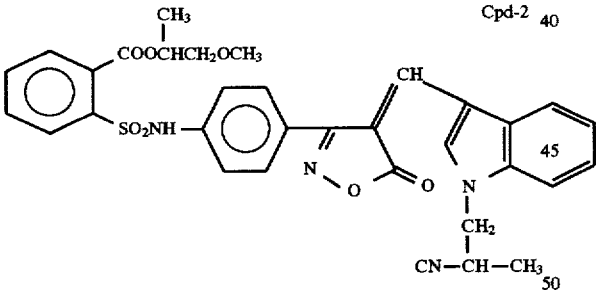

H-1

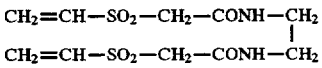

The twelfth layer (low-speed blue sensitive emulsion layer)

| | |
|---|---|
| Silver iodobromide emulsion L (amount of silver coated) | 0.40 |
| Silver iodobromide emulsion M (amount of silver coated) | 0.20 |
| Silver iodobromide emulsion N (amount of silver coated) | 0.30 |
| Gelatin | 1.75 |
| ExS-6 | $9.0 \times 10^{-4}$ |
| ExY-4 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |

-continued

| | |
|---|---|
| ExC-2 | $8.0 \times 10^{-2}$ |
| Solv-1 | 0.54 |

ExS-6

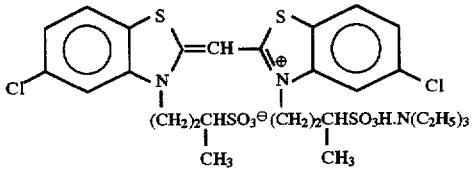

ExY-3

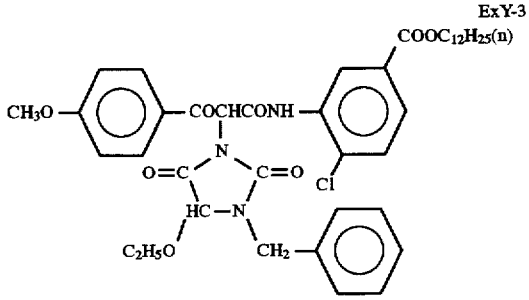

The thirteenth layer (intermediate layer)

| | |
|---|---|
| Gelatin | 0.60 |
| ExY-4 | 0.14 |
| Solv-1 | 0.14 |

ExY-4

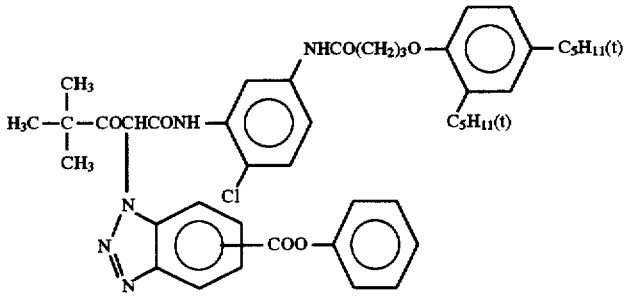

The fourteenth layer (high-speed blue sensitive emulsion layer)

| | |
|---|---|
| Emulsion P (amount of silver coated) | 0.80 |
| Gelatin | 0.95 |
| ExS-6 | $4.0 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |

The fifteenth layer (first protective layer)

Fine-grain silver iodobromide emulsion 0

| | |
|---|---|
| (amount of silver coated) | 0.12 |
| Gelatin | 0.63 |
| UV-4 | 0.11 |
| UV-5 | 0.18 |
| Cpd-3 | 0.10 |
| Solv-4 | $2.0 \times 10^{-2}$ |
| Polyethyl acrylate latex | $9.0 \times 10^{-2}$ |

Cpd-3

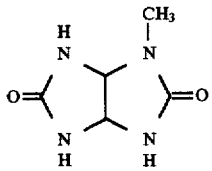

Solv-4

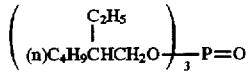

The sixteenth layer (second protective layer)

Fine-grain silver iodobromide emulsion 0

| | |
|---|---|
| (amount of silver coated) | 0.36 |
| Gelatin | 0.85 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-5 | $2.0 \times 10^{-2}$ |
| H-1 | 0.18 |

B-1

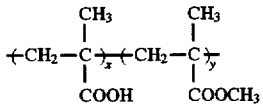

x/y = 10/90

-continued

B-2

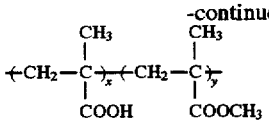

x/y = 40/60

B-3

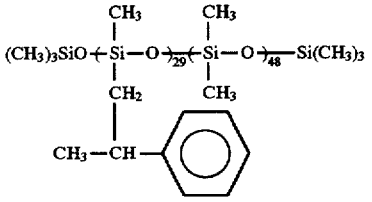

W-5

$C_8F_{17}SO_2N(C_3H_7)CH_2COOK$

In addition to the above-described additives, 1,2-benzisothiazoline-3-on (average amount with respect to gelatin: 200 ppm), n-buthyl-p-hydroxybenzoate (average amount with respect to gelatin: 1,000 ppm), and 2-phenoxyethanol (average amount with respect to gelatin: 10,000 ppm) were added to the samples prepared as above. Further, in order to improve storage properties, processing properties, pressure sensitiveness, mildewproof/anti-bacterial properties, electrostatic charge preventing properties, and coating properties, additives W-1 through W6, B-1 through B-6, F-16 through F-16, iron salt, lead salt, gold salt, platinum gold, iridium salt, and rhodium salt were appropriately contained in each of the samples.

W-1

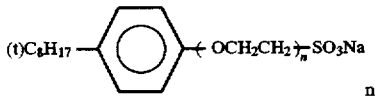

n = 2–4

W-2

$C_8F_{17}SO_2NHCH_2CH_2CH_2OCH_2CH_2\overset{\oplus}{N}(CH_3)_3$

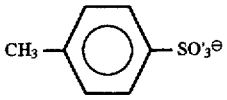

W-3

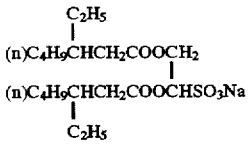

W-4

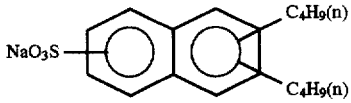

-continued
W-6
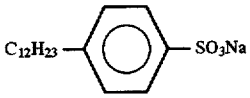
B-4
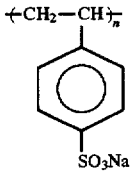
B-5
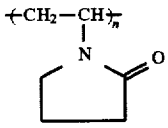
(mol. wt. about 10,000)
B-6 x/y = 70/30
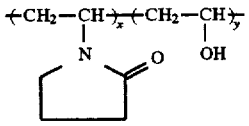
F-1
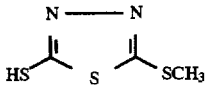
F-2
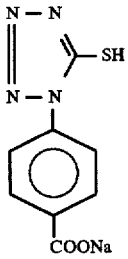
F-3
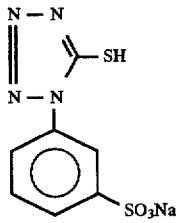
F-4
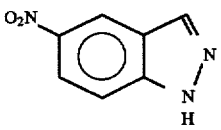
F-5
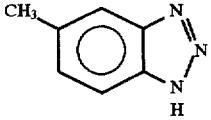
F-6
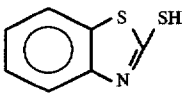
-continued
F-7
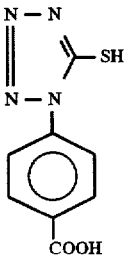
F-8
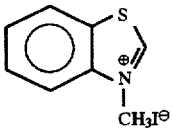
F-9
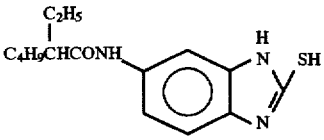
F-10
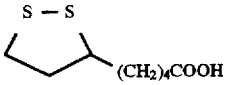
F-11
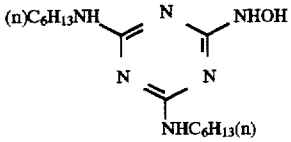
F-12
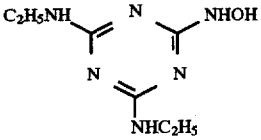
F-13
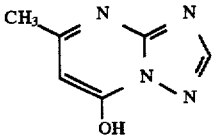
F-14
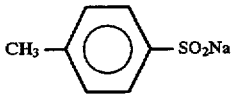
F-15
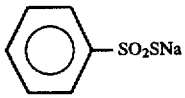
F-16
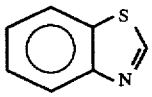
TABLE 1
| Emulsion | Average AgI content (mole %) | Average grain diameter (diameter of corresponding sphere/μm) | Coefficient of variation in grain-diameter distribution (%) | Diameter/ thickness ratio |
|---|---|---|---|---|
| A | 4.7 | 0.40 | 10 | 1.0 |
| B | 6.0 | 0.49 | 23 | 2.0 |

TABLE 1-continued

| | | | | |
|---|---|---|---|---|
| C | 8.4 | 0.65 | 23 | 2.2 |
| D | 8.8 | 0.65 | 15 | 3.5 |
| E | 4.0 | 0.35 | 25 | 2.8 |
| F | 4.0 | 0.50 | 18 | 4.0 |
| G | 3.5 | 0.55 | 15 | 3.5 |
| H | 10.0 | 0.70 | 20 | 5.5 |
| I | 3.8 | 0.70 | 15 | 3.5 |
| J | 8.0 | 0.65 | 28 | 2.5 |
| K | 10.3 | 0.40 | 15 | 1.0 |
| L | 9.0 | 0.66 | 19 | 5.8 |
| M | 2.5 | 0.46 | 30 | 7.0 |
| N | 13.9 | 1.30 | 25 | 3.0 |
| O | 2.0 | 0.07 | 15 | 1.0 |

| Emulsion | Silver amount ratio [core/medium/shell] (AgI content) | Grain structure and shape |
|---|---|---|
| A | [4/1/5] (1/38/1) | Triple-structure cubic grains |
| B | [1/2] (16/1) | Double-structure flat grains |
| C | [3/5/2] (0/14/7) | Triple-structure flat grains |
| D | [12/59/29] (0/12/6) | Triple-structure tabular grains |
| E | — | Homogeneous-structure flat grains |
| F | — | Homogeneous-structure tabular grains |
| G | [12/59/29] (0/5/2) | Triple-structure tabular grains |
| H | [12/59/29] (0/13/8) | Triple-structure tabular grains |
| I | [12/59/29] (0/5/3) | Triple-structure tabular grains |
| J | [1/2] (18/3) | Double-structure flat grains |
| K | [1/3] (29/4) | Double-structure octahedral grains |
| L | [8/59/33] (0/11/8) | Triple-structure tabular grains |
| M | — | Homogeneous-structure tabular grains |
| N | [7/13] (34/3) | Double-structure flat grains |
| O | — | Homogeneous-structure fine grains |

The samples prepared as described above were cut into pieces of 24 mm in width and 160 cm in length. A pair of perforations of 2 millimeters square were provided at the positions of 0.7 mm from one edge of the sample, the perforations being apart from each other at a distance of 5.8 mm in the longitudinal direction of the samples. The pair of perforations were provided at a distance of 32 mm in the longitudinal direction of the sample. The sample thus prepared was accommodated in a plastic cartridge described in U.S. Pat. No. 5,296,887 (FIGS. 1 through 7).

Digital saturation recording having a recording wavelength of 50 μm was carried out at a speed of 100 mm/second on the magnetic recording layer between the perforations of the sample from the side of the magnetic recording layer, by using an audio magnetic recording head formed off Permalloy with a head gap of 5 μm and a turn number of 50/second.

The above-described samples were subjected to gray exposure of 5 cms at a color temperature of 4800K and processed in the following processing steps and with processing solutions by a cine-type automatic processor. thereafter, the processed samples were accommodated in an original plastic cartridge. In the following processing steps, running processing of a photosensitive material was carried out for ten days by 1 $m^2$ a day.

The ISO sensitivity of each of these samples was 250 to 200.

A description will be hereinafter given of the processing used in the present invention.

Color developing processing and bleaching/fixing processing are respectively effected by using a cine-type automatic processor in which a photosensitive material is conveyed in the air between the adjacent processing tanks (each crossover time is 5 seconds). Stabilizing processing (1) through (8) is effected by using the automatic processing apparatus of the first embodiment. Floating fluid layers each having a thickness of 5 mm according to the present invention was floated on each of the processing solutions in the processing tanks for stabilizing processing (1), (2) and (3). As comparative examples, the floating balls described in JP-A No. 61-258245 were used.

The processing steps and the compositions of the processing solutions are described below.

(Processing steps)

| Step | Temperature | Time | Quantity of replenishing | Tank capacity |
|---|---|---|---|---|
| Color Development | 45° C. | 70 sec. | 260 ml/$m^2$ | 2 liters |
| Bleach/ Fixing | 40° C. | 90 sec. | 260 ml/$m^2$ | 3 liters |
| Stabilization (1) | 40° C. | see Table 2 | — | 1 liter |
| Stabilization (2) | 40° C. | see Table 2 | — | 1 liter |
| Stabilization (3) | 40° C. | see Table 2 | see Table 2 | 1 liter |
| Drying | 75° C. | 30 sec. | — | |

A counter current system from the stabilizing steps (3) to (1) was used in the stabilizing steps.

Each time of the stabilizing steps (1) through (3) is all the same, and the total time was described in Table 2.

The composition of each of the processing solution was as follows:

(Color developer)

| | Tank solution (g) | Replenishing solution (g) |
|---|---|---|
| Diethylenetriamine-pentaacetic acid | 3.0 | 4.0 |
| Tiron | 3.0 | 3.0 |
| Sodium sulfite | 4.0 | 6.7 |
| Potassium carbonate | 39.0 | 39.0 |
| Potassium bromide | 2.0 | 0 |
| Potassium iodide | 0.0013 | 0 |
| Disodium-N,N-bis(2-sulfonateethyl) hydroxylamine | 10.0 | 13.0 |
| 4-amino-3-methyl-N-ethyl-N-(2-hydroxyethyl) aniline | 10.0 | 16.0 |
| Water up to | 1 liter | 1 liter |
| pH (adjusted with potassium hydroxide and sulfuric acid) | 10.05 | 10.35 |

(Bleach-fixing solution)

| | Tank solution (g) | Replenishing solution (g) |
|---|---|---|
| N,N'-bis(carboxymethyl)-N-(1-carboxyethyl)-N'-(2-carboxyphenyl)ethylenediamine | 0.18 mole | 0.20 mole |
| Ferric chloride | 0.16 mole | 0.18 mole |
| Aqueous ammonium thiosulfate (750 g/liter) | 300 ml | 300 ml |
| Ammonium iodide | 1.0 | — |
| Ammonium sulfite | 20.0 | 45.0 |
| p-sodium toluene sulfinic acid | 20.0 | 25.0 |
| succinic acid | 12.0 | 12.0 |
| Water up to | 1.0 liter | 1.0 liter |
| pH (adjusted with nitric acid and aqueous ammonia) | 6.0 | 5.5 |

(Stabilizing solution)

The compositions of the tank solution and the replenishing solution are the same.

| | |
|---|---|
| p-sodium toluene sulfinic acid | 0.03 |
| 1,2-benzisothiazoline-3-on | 0.05 |
| Polyoxyethylene-p-monononylphenylether (average degree of polymerization: 10) | 0.2 |
| Disodium ethylenediaminetetraacetic acid | 0.05 |
| 1,2,4-triazole | 1.3 |
| 1,4-bis(1,2,4-triazole-1-ylmethyl)piperazine | 0.75 |
| Water | 1,000 ml |
| pH (adjusted with NaOH and glycol acid) | 6.5 |

The change in minimum density of yellow color before and after running processing and the output of magnetic recording after running processing were evaluated, by methods as described below, on the photosensitive materials processed in the above-described manner.

(Measurement of minimum density of yellow color)

Measurement of gradation of the photosensitive materials was carried out by reading the change in minimum density of yellow color on the characteristic curves in an initial stage of the running processing and after the running processing so as to obtain the difference in density (Δ Dmin).

(Method of measuring output of magnetic recording)

An output signal level of an isolated reproducing wave was measured on the processed photosensitive material by using a magnetic reproducing head made of Permalloy material, with a head gap of 2.5 μm and a turn number of 2000/second. An average output level of the photosensitive material before storage was assumed to be 100, and the average output level after storage when compared with the value before storage was represented by the percentage.

Unless at least 85% off the output of magnetic recording information is maintained, reading errors will occur.

The results thus obtained are shown in Table 2-1 and Table 2-2.

TABLE 2-1

| Process No. | Floating lid of washing/stabilizing tank | Total processing time of washing and stabilization (sec.) | Change in minimum density of yellow color (Δ Dmin) | Output of magnetic recording (%) | Remarks |
|---|---|---|---|---|---|
| 1 | Floating ball* | 70 | 0.03 | 90 | Comparative Example |
| 2 | Floating ball* | 60 | 0.05 | 82 | Comparative Example |
| 3 | Floating ball* | 50 | 0.07 | 77 | Comparative Example |
| 4 | Floating ball* | 35 | 0.12 | 73 | Comparative Example |
| 5 | Floating ball* | 15 | 0.14 | 71 | Comparative Example |
| 6 | Liquid paraffin | 70 | 0.01 | 93 | Present Invention |
| 7 | Liquid paraffin | 60 | 0.01 | 92 | Present Invention |
| 8 | Liquid paraffin | 50 | 0.01 | 90 | Present Invention |
| 9 | Liquid paraffin | 35 | 0.02 | 89 | Present Invention |
| 10 | Liquid paraffin | 15 | 0.03 | 87 | Present Invention |
| 11 | Dodecane | 50 | 0.01 | 89 | Present Invention |
| 12 | Tetra-decane | 50 | 0.02 | 90 | Present Invention |

*Floating ball: the floating body described in JP-A No. 61-258245
Total amount of replenisher of washing water and stabilizing solution = 700 ml/m$^2$

TABLE 2-2

| Process No. | Floating lid of washing/stabilizing tank | Total amount of replenisher of washing water and stabilizing solution (ml/m$^2$) | Change in minimum density of yellow color (Δ Dmin) | Output of magnetic recording (%) | Remarks |
|---|---|---|---|---|---|
| 13 | Floating ball* | 900 | 0.03 | 90 | Comparative Example |
| 14 | Floating ball* | 800 | 0.06 | 83 | Comparative Example |
| 15 | Floating ball* | 700 | 0.07 | 73 | Comparative Example |
| 16 | Floating ball* | 600 | 0.10 | 67 | Comparative Example |
| 17 | Floating ball* | 350 | 0.14 | 51 | Comparative Example |
| 18 | Floating ball* | 200 | 0.18 | 49 | Comparative Example |
| 19 | Floating ball* | 130 | 0.20 | 42 | Comparative Example |
| 20 | Liquid paraffin | 900 | 0.01 | 93 | Present Invention |
| 21 | Liquid paraffin | 800 | 0.01 | 91 | Present Invention |
| 22 | Liquid paraffin | 700 | 0.01 | 90 | Present Invention |
| 23 | Liquid paraffin | 600 | 0.02 | 90 | Present Invention |
| 24 | Liquid paraffin | 350 | 0.02 | 88 | Present Invention |
| 25 | Liquid paraffin | 200 | 0.02 | 87 | Present Invention |
| 26 | Liquid paraffin | 130 | 0.03 | 85 | Present Invention |
| 27 | Dodecane | 600 | 0.02 | 89 | Present Invention |
| 28 | Tetra-decane | 600 | 0.02 | 88 | Present Invention |

*Floating ball: the floating body described in JP-A No. 61-258245
Total processing time for washing and stabilization = 50 seconds The results of Table 2-1 are as follows. In Process 1 through 5 in which floating balls are used, the photographic properties and magnetic outputs in Process 1 in which the total processing time for washing and stabilization is 70 seconds were both excellent. However, when the total processing time for washing and stabilization is 60 seconds or less, the photographic properties deteriorate, particularly, the change in minimum density of yellow color remarkedly becomes larger, and the output of magnetic recording was an unacceptable level. Meanwhile, in Process 6 through 12 in which a liquid floating layer (for example, a liquid paraffin, dodecane, tetradecane), even when the total processing time for washing and stabilization is 60 seconds or less, the photographic properties and the magnetic output were excellent.

It can be understood that, when a combination of the sealing structure at the periphery of the roller according to the present invention and the liquid floating layer is used, the total time of stabilization processing is preferably 15 to 60 seconds.

The results of Table 2-2 are as follows. In Process 13 through 19 in which the floating balls are used, the photographic properties and the magnetic output in Process 13 in which the total amount of replenisher of washing water and stabilizing solution is 900 ml/m$^2$ were both excellent. However, when the total amount of replenisher of washing water and stabilizing solution is 800 ml/m$^2$ or less, the photographic properties deteriorate, particularly, the change in minimum density of yellow color remarkedly becomes larger, and the output of magnetic recording also becomes an unacceptable level. Meanwhile, in Processes 20 through 28 in which a liquid floating layer (for example, liquid paraffin, dodecane, tetradecane), even when the total amount of replenisher of washing water and stabilizing solution is 800 ml/m$^2$ or less, the photographic properties and magnetic outputs were both excellent.

It can be understood that, when a combination of the sealing structure at the periphery of the roller according to the present invention and the liquid floating layer is used, the total amount of replenisher of washing water and stabilizing solution is preferably 130 to 800 ml/m$^2$.

TABLE 3

| Process No. | Floating lid of washing/stabilizing tank | Total processing time of washing and stabilization (sec.) | Change in minimum density of yellow color (Δ Dmin) | Output of magnetic recording (%) | Conveying method in washing processes (1) to (3) | Remarks |
|---|---|---|---|---|---|---|
| 1 | Floating ball* | 70 | 0.03 | 90 | Roller pair | Comp. Ex. |
| 2 | Floating ball* | 60 | 0.05 | 82 | Roller pair | Comp. Ex. |
| 3 | Floating ball* | 50 | 0.07 | 77 | Roller pair | Comp. Ex. |
| 6 | Liquid paraffin | 70 | 0.01 | 93 | Roller pair | Pres. Inv. |
| 7 | Liquid paraffin | 60 | 0.01 | 92 | Roller pair | Pres. Inv. |
| 8 | Liquid paraffin | 50 | 0.01 | 90 | Roller pair | Pres. Inv. |
| 29 | Floating ball* | 70 | 0.05 | 80 | Air-Conveying | Comp. Ex. |
| 30 | Floating ball* | 60 | 0.07 | 75 | Air-Conveying | Comp. Ex. |
| 31 | Floating ball* | 50 | 0.10 | 72 | Air-Conveying | Comp. Ex. |
| 32 | Liquid paraffin | 70 | 0.02 | 65 | Air-Conveying | Comp. Ex. |
| 33 | Liquid paraffin | 60 | 0.02 | 60 | Air-Conveying | Comp. Ex. |
| 34 | Liquid paraffin | 50 | 0.02 | 51 | Air-Conveying | Comp. Ex. |

*Floating ball: the floating body described in JP-A No. 61-258245
Total amount of replenisher of washing water and stabilizing solution = 700 ml/m$^2$ (Third Embodiment)

In this embodiment, the same photosensitive material as that off the second embodiment was used, and color developing and bleaching/fixing processing were effected by using a cine-type automatic processor in which a photosensitive material is conveyed in the air between the adjacent processing tanks (each crossover time is 5 seconds). Floating fluid layers each having a thickness of 5 mm according to the present invention, or the floating balls described in JP-A No. 61-258248 floated on the processing solutions in the stabilizing processing tanks (1), (2) and (3).

The processing steps are described below and the compositions of the processing solutions of the second embodiment were used.

(Processing steps)

| Step | Temperature | Time | Quantity of replenishing | Tank capacity |
|---|---|---|---|---|
| Color Development | 45° C. | 70 sec. | 260 ml/m$^2$ | 2 liters |
| Bleach/ | 40° C. | 90 sec. | 260 ml/m$^2$ | 3 liters |

-continued (Processing steps)

| Step | Temperature | Time | Quantity of replenishing | Tank capacity |
|---|---|---|---|---|
| Fixing | | | | |
| Stabilizing (1) | 40° C. | see Table 3 | — | 1 liter |
| Stabilizing (2) | 40° C. | see Table 3 | — | 1 liter |
| Stabilizing (3) | 40° C. | see Table 3 | see Table 3 | 1 liter |
| Drying | 75° C. | 30 sec. | — | |

A counter current system from the stabilizing steps (8) to (1) was used in the stabilizing steps.

Each time of the stabilizing steps (1) through (3) is all the same, and the total time was shown in Table 3.

The results of Processes 1, 2, 3, 6, 7 and 8 are the same as those of the second embodiment. The experimental results of an air conveying method were shown in Processes 29 through 34. When the results of Processes 1 through 3 are compared with those of Processes 29 through 31, Processes 29 through 31 exhibited that the change in minimum density of yellow color becomes larger still further and that small scratches are formed on the surface of the photosensitive material. The photosensitive material cannot stand long use.

Further, in Processes 32 through 34 in which the air conveying method and the liquid paraffin were used, it was exhibited that the magnetic recording outputs deteriorate extremely. Then, it is clearly seen from Processes 6 through 8 that a combination of the roller pair and the liquid floating layer is preferable.

By using the photosensitive material processing apparatus of the present invention in which the roller structure is provided and a liquid surface of the processing solution in the processing tank is covered by a fluid layer which floats on the liquid surface, it is possible to obtain excellent photographic properties and magnetic recording outputs in the running processing.

What is claimed is:

1. A method of processing a silver halide photosensitive material using a photosensitive material processing apparatus in which a photosensitive material is immersed and processed in a processing solution having a developing capability, a processing solution having a desilverizing capability and a processing solution for at least one of washing and stabilization, these processing solutions being respectively accommodated in a plurality of processing tanks disposed adjacent to each other along a direction in which the photosensitive material is conveyed, said photosensitive material processing apparatus comprising: a conveying roller pair for conveying the photosensitive material, which is provided in at least one portion of said photosensitive material processing apparatus; sealing means for sealing the periphery of said conveying roller; and a partition portion which is partitioned by a roller which is provided in at least one portion between adjacent processing tanks of the plurality of processing tanks to allow the photosensitive material to pass therethrough, wherein a processing solution in at least one of the plurality of processing tanks is covered by a fluid layer which floats on a liquid surface of the processing solution.

2. A method of processing a silver halide photosensitive material according to claim 1, wherein said fluid layer is formed on the surface of the processing solution in an least the processing tank for at least one of washing and stabilization of the plurality of processing tanks.

3. A method of processing a silver halide photosensitive material according to claim 2, where said photosensitive material processing apparatus includes a partition which is provided to separate the processing tanks from each other and in which an opening through which the photosensitive material can pass is formed; a pair of side plates projecting from vicinities of the opening of said partition; a roller which is interposed between said pair of side plates and contacts the photosensitive material passing through the opening so as to capable of applying conveying force to the photosensitive material; a first sealing means which seals clearances between an upper surface of a peripheral surface of the roller along an axial direction of said roller and a peripheral edge of the opening of said partition, and between a lower surface of the peripheral surface of the roller along the axial direction of said roller and the peripheral edge of the opening of said partition, so as to prevent flowing of the processing solutions therebetween; and a second sealing means which is provided between one end surface of said roller and one of said pair off side plates, and between the other end surface of said roller and the other of said pair of side plates, and seals clearances between the end surfaces of said roller and said pair of side plates to prevent the processing solution from flowing through the clearances.

4. A method of processing a silver halide photosensitive material according to claim 2, wherein a total processing time of the photosensitive material with said processing solution for at least one of washing and stabilizing is 15 seconds to 60 seconds.

5. A method of processing a silver halide photosensitive material according to claim 3, wherein a total processing time of the photosensitive material with said processing solution for at least one of washing and stabilizing is 15 seconds to 60 seconds.

6. A method of processing a silver halide photosensitive material according to claim 2, wherein an amount of a replenisher of the processing solution for at least one of washing and stabilizing is 130 to 800 ml per 1 $m^2$ of the photosensitive material.

7. A method of processing a silver halide photosensitive material according to claim 3, wherein an amount of a replenisher of the processing solution for at least one of washing and stabilizing is 130 to 800 ml per 1 $m^2$ of the photosensitive material.

8. A method of processing a silver halide photosensitive material according to claim 4, wherein an amount of a replenisher of the processing solution for at least one of washing and stabilizing is 130 to 800 ml per 1 $m^2$ of the photosensitive material.

9. A method of processing a silver halide photosensitive material according to claim 5, wherein an amount of a replenisher of the processing solution for at least one of washing and stabilizing is 130 to 800 ml per 1 $m^2$ of the photosensitive material.

10. A method of processing a silver halide photosensitive material according to claim 1, wherein the photosensitive material has, on a support thereof, at least one red sensitive layer, at least one green sensitive layer, at least one blue sensitive layer, and a magnetic recording layer containing magnetic particles.

11. A method of processing a silver halide photosensitive material according to claim 2, wherein the photosensitive material has, on a support thereof, at least one red sensitive layer, at least one green sensitive layer, at least one blue sensitive layer, and a magnetic recording layer containing magnetic particles.

12. A method of processing a silver halide photosensitive material according to claim 3, wherein the photosensitive material has, on a support thereof, at least one red sensitive layer, at least one green sensitive layer, at least one blue sensitive layer, and a magnetic recording layer containing magnetic particles.

13. A method of processing a silver halide photosensitive material according to claim 4, wherein the photosensitive material has, on a support thereof, at least one red sensitive layer, at least one green sensitive layer, at least one blue sensitive layer, and a magnetic recording layer containing magnetic particles.

14. A method of processing a silver halide photosensitive material according to claim 1, wherein the fluid forming the fluid layer has water content of 10% by weight or less, a specific gravity of 1.000 or less, a boiling point of 100° C. or more, and substantially does not react with a processing solution or a replenisher, and has a relative dielectric constant of 2 to 20.

15. A method of processing a silver halide photosensitive material according to claim 2, wherein the fluid forming the fluid layer has water content of 10% by weight or less, a specific gravity of 1.000 or less, a boiling point of 100° C. or more, and substantially does not react with a processing solution or a replenisher, and has a relative dielectric constant of 2 to 20.

16. A method of processing a silver halide photosensitive material according to claim 14, wherein the fluid forming the fluid layer is at least one compound selected from the group of liquid paraffin and liquid saturated hydrocarbons having 8 to 16 carbons.

17. A method of processing a silver halide photosensitive material according to claim 15, wherein the fluid forming the fluid layer is at least one compound selected from the group of liquid paraffin and liquid saturated hydrocarbons having 8 to 16 carbons.

18. A method of processing a silver halide photosensitive material according to claim 16, wherein the liquid saturated hydrocarbons is at least one compound selected from the group of nonane, decane, undecane, dodecane, tridecane, tetradecane, and pentadecane.

19. A method of processing a silver halide photosensitive material according to claim 17, wherein the liquid saturated hydrocarbons is at least one compound selected from the group of nonane, decane, undecane, dodecane, tridecane, tetradecane, and pentadecane.

* * * * *

UNITED STATES PATENT AND TRADEMARK OFFICE

CERTIFICATE OF CORRECTION

PATENT NO. : 5,723,266

DATED : March 3, 1998

INVENTOR(S) : Morimoto

It is certified that error appears in the above-identified patent and that said Letters Patent is hereby corrected as shown below:

Title page, item [73] Assignee , please change "Tokyo, Japan" to

--Kanagawa, Japan--.

Signed and Sealed this

Eleventh Day of April, 2000

*Attest:*

*Attesting Officer*

Q. TODD DICKINSON

*Director of Patents and Trademarks*